US011499563B2

(12) United States Patent
Badr et al.

(10) Patent No.: US 11,499,563 B2
(45) Date of Patent: Nov. 15, 2022

(54) SELF-BALANCING THRUST DISK

(71) Applicants: King Fahd University of Petroleum & Minerals, Dhahran (SA); Saudi Arabian Oil Company, Dhahran (SA)

(72) Inventors: Hassan Mohamed Badr, Dhahran (SA); Jinjiang Xiao, Dhahran (SA); Chidirim Enoch Ejim, Dhahran (SA)

(73) Assignees: Saudi Arabian Oil Company, Dhahran (SA); King Fahd University of Petroleum & Minerals, Dhahran (SA)

( * ) Notice: Subject to any disclaimer, the term of this patent is extended or adjusted under 35 U.S.C. 154(b) by 262 days.

(21) Appl. No.: 17/001,445

(22) Filed: Aug. 24, 2020

(65) Prior Publication Data

US 2022/0056913 A1 Feb. 24, 2022

(51) Int. Cl.
*F04D 29/041* (2006.01)
*E21B 43/12* (2006.01)
(Continued)

(52) U.S. Cl.
CPC ..... *F04D 29/041* (2013.01); *E21B 43/128* (2013.01); *F04D 13/086* (2013.01);
(Continued)

(58) Field of Classification Search
CPC ... F04D 1/06; F04D 1/08; F04D 13/08; F04D 13/086; F04D 13/10; F04D 29/00;
(Continued)

(56) References Cited

U.S. PATENT DOCUMENTS 335,164 A 2/1886 Vitalis
646,887 A 4/1900 Stowe et al.
(Continued)

FOREIGN PATENT DOCUMENTS

CA 1226325 9/1987
CA 2629578 10/2009
(Continued)

OTHER PUBLICATIONS

PCT International Search Report and Written Opinion in International Appln. No. PCT/US2021/046862, dated Dec. 10, 2021, 15 pages.

(Continued)

*Primary Examiner* — Charles G Freay
*Assistant Examiner* — Chirag Jariwala
(74) *Attorney, Agent, or Firm* — Fish & Richardson P.C.

(57) ABSTRACT

A thrust balancing apparatus for a pump includes a housing, a balancing chamber, a connecting tube, a balancing disk, a bushing, a washer, and a pair of upthrust washers. The balancing chamber defines an upper cavity and a lower cavity. The connecting tube is configured to establish fluid communication between the balancing chamber and an exterior of the housing. A first portion of the balancing disk is disposed within the upper cavity. A second portion of the balancing disk passes through the lower cavity. A third portion of the balancing disk is external to the balancing chamber. The washer is disposed between the balancing disk and the bushing. The pair of upthrust washers are disposed between the balancing disk and the balancing chamber.

19 Claims, 6 Drawing Sheets

(51) Int. Cl.
*F04D 13/08* (2006.01)
*F04D 13/10* (2006.01)
*F04D 29/043* (2006.01)

(52) U.S. Cl.
CPC ..... *F04D 13/10* (2013.01); *F04D 29/043* (2013.01); *F04D 29/0416* (2013.01)

(58) Field of Classification Search
CPC ..... F04D 29/007; F04D 29/04; F04D 29/041; F04D 29/0416; F04D 29/043; F04D 29/047; F04D 29/0473; F04D 29/0476; E21B 43/128; F16C 17/04; F16C 17/042; F16C 17/045; F16C 17/047; F16C 17/06; F16C 17/065; F16C 17/14; F16C 17/26; F16C 33/08; F16C 33/74; F16C 41/02; F16C 2360/44
See application file for complete search history.

(56) References Cited

U.S. PATENT DOCUMENTS 1,485,504 A * 3/1924 Hollander ..... F04D 29/0416 415/106
1,559,155 A 10/1925 Bullock
1,677,093 A * 7/1928 Johnson ..... F16C 17/26 384/304
1,912,452 A 6/1933 Hollander
1,978,277 A 10/1934 Noble
2,287,027 A 6/1942 Cummins
2,556,435 A 6/1951 Moehrl
2,625,110 A 1/1953 Haentjens et al.
2,641,191 A 6/1953 Alfred
2,782,720 A 2/1957 Dochterman
2,845,869 A 8/1958 Herbenar
2,866,417 A 12/1958 Otto
2,931,384 A 4/1960 Clark
3,007,418 A 11/1961 Brundage et al.
3,034,484 A 5/1962 Stefancin
3,038,698 A 6/1962 Troyer
3,123,010 A 3/1964 Witt et al.
3,129,875 A 4/1964 Cirillo
3,139,835 A 7/1964 Wilkinson
3,158,415 A * 11/1964 Garnder ..... F16C 41/02 384/304
3,171,355 A 3/1965 Harris et al.
3,175,403 A 3/1965 Nelson
3,251,226 A 5/1966 Cushing
3,272,130 A 9/1966 Mosbacher
3,413,925 A 12/1968 Campolong
3,516,765 A 6/1970 Boyadjieff
3,638,732 A 2/1972 Huntsinger et al.
3,680,989 A 8/1972 Brundage
3,724,503 A 4/1973 Cooke
3,746,461 A * 7/1973 Yokota ..... F04D 29/0416 415/104
3,771,910 A 11/1973 Laing
3,795,145 A 3/1974 Miller
3,814,486 A * 6/1974 Schurger ..... F16C 32/0692 384/125
3,839,914 A 10/1974 Modisette et al.
3,874,812 A 4/1975 Hanagarth
3,961,758 A 6/1976 Morgan
3,975,117 A 8/1976 Carter
4,025,244 A 5/1977 Sato
4,096,211 A 6/1978 Rameau
4,139,330 A 2/1979 Neal
4,154,302 A 5/1979 Cugini
4,181,175 A 1/1980 McGee et al.
4,226,275 A 10/1980 Frosch
4,266,607 A 5/1981 Halstead
4,289,199 A 9/1981 McGee
4,336,415 A 6/1982 Walling
4,374,530 A 2/1983 Walling
4,387,685 A 6/1983 Abbey
4,417,474 A 11/1983 Elderton
4,425,965 A 1/1984 Bayh, III et al.
4,440,221 A 4/1984 Taylor et al.
4,476,923 A 10/1984 Walling
4,491,176 A 1/1985 Reed
4,497,185 A 2/1985 Shaw
4,576,043 A 3/1986 Nguyen
4,580,634 A 4/1986 Cruise
4,582,131 A 4/1986 Plummer et al.
4,586,854 A 5/1986 Newman et al.
4,619,323 A 10/1986 Gidley
4,627,489 A 12/1986 Reed
4,632,187 A 12/1986 Bayh, III et al.
4,658,583 A 4/1987 Shropshire
4,662,437 A 5/1987 Renfro
4,665,981 A 5/1987 Hayatdavoudi
4,741,668 A 5/1988 Bearden et al.
4,757,709 A 7/1988 Czernichow
RE32,866 E 2/1989 Cruise
4,838,758 A 6/1989 Sheth
4,850,812 A 7/1989 Voight
4,856,344 A 8/1989 Hunt
4,867,633 A 9/1989 Gravelle
4,969,364 A 11/1990 Masuda
4,986,739 A 1/1991 Child
5,033,937 A 7/1991 Wilson
5,094,294 A 3/1992 Bayh, III et al.
5,158,440 A 10/1992 Cooper et al.
5,169,286 A 12/1992 Yamada
5,180,014 A 1/1993 Cox
5,195,882 A 3/1993 Freeman
5,201,848 A 4/1993 Powers
5,209,650 A 5/1993 Lemieux
5,261,796 A 11/1993 Niemiec et al.
5,269,377 A 12/1993 Martin
5,285,008 A 2/1994 Sas-Jaworsky et al.
5,323,661 A 6/1994 Cheng
5,334,801 A 8/1994 Mohn
5,335,542 A 8/1994 Ramakrishnan et al.
5,337,603 A 8/1994 McFarland et al.
5,358,378 A 10/1994 Holscher
5,482,117 A 1/1996 Kolpak
5,494,413 A 2/1996 Campen et al.
5,591,922 A 1/1997 Segeral et al.
5,605,193 A 2/1997 Bearden et al.
5,613,311 A 3/1997 Burtch
5,620,048 A 4/1997 Beauquin
5,641,915 A 6/1997 Ortiz
5,649,811 A 7/1997 Krol, Jr. et al.
5,653,585 A 8/1997 Fresco et al.
5,693,891 A 12/1997 Brown
5,736,650 A 4/1998 Hiron et al.
5,755,288 A 5/1998 Bearden et al.
5,834,659 A 11/1998 Ortiz
5,845,709 A 12/1998 Mack et al.
5,848,642 A 12/1998 Sola
5,880,378 A 3/1999 Behring
5,886,267 A 3/1999 Ortiz et al.
5,905,208 A 5/1999 Ortiz et al.
5,908,049 A 6/1999 Williams et al.
5,921,285 A 7/1999 Quigley et al.
5,954,305 A 9/1999 Calabro
6,113,675 A 9/2000 Branstetter
6,129,507 A 10/2000 Ganelin
6,148,866 A 11/2000 Quigley et al.
6,155,102 A 12/2000 Toma
6,164,308 A 12/2000 Butler
6,167,965 B1 1/2001 Bearden et al.
6,176,323 B1 1/2001 Weirich
6,179,269 B1 1/2001 Kobylinski et al.
6,192,983 B1 2/2001 Neuroth et al.
6,257,332 B1 7/2001 Vidrine et al.
6,264,440 B1 7/2001 Klein et al.
6,286,558 B1 9/2001 Quigley et al.
6,289,990 B1 9/2001 Dillon et al.
6,298,917 B1 10/2001 Kobylinski et al.
6,325,143 B1 12/2001 Scarsdale
6,357,485 B2 3/2002 Quigley et al.
6,361,272 B1 3/2002 Bassett

(56) References Cited

U.S. PATENT DOCUMENTS 6,413,065 B1 7/2002 Dass
6,414,239 B1 7/2002 Gasque, Jr.
6,427,778 B1 8/2002 Beall et al.
6,454,010 B1 9/2002 Thomas et al.
6,463,810 B1 10/2002 Liu
6,530,211 B2 3/2003 Holtzapple et al.
6,544,013 B2 4/2003 Kato et al.
6,546,812 B2 4/2003 Lewis
6,547,519 B2 4/2003 deBlanc et al.
6,550,327 B1 4/2003 Van Berk
6,557,642 B2 5/2003 Head
6,601,460 B1 8/2003 Materna
6,601,651 B2 8/2003 Grant
6,604,550 B2 8/2003 Quigley et al.
6,629,564 B1 10/2003 Ramakrishnan et al.
6,679,692 B1 1/2004 Feuling et al.
6,681,894 B1 1/2004 Fanguy
6,726,449 B2 4/2004 James et al.
6,733,249 B2 5/2004 Maier et al.
6,741,000 B2 5/2004 Newcomb
6,755,609 B2 6/2004 Preinfalk
6,776,054 B1 8/2004 Stephenson
6,807,857 B2 10/2004 Storm, Jr.
6,808,371 B2 10/2004 Niwatsukino et al.
6,811,382 B2 11/2004 Buchanan et al.
6,848,539 B2 2/2005 Lee et al.
6,856,132 B2 2/2005 Appel et al.
6,857,452 B2 2/2005 Quigley et al.
6,863,137 B2 3/2005 Terry et al.
6,935,189 B2 8/2005 Richards
6,993,979 B2 2/2006 Segeral
7,017,681 B2 3/2006 Ivannikov et al.
7,021,905 B2 4/2006 Torrey et al.
7,032,662 B2 4/2006 Malone et al.
7,086,294 B2 8/2006 DeLong
7,093,665 B2 8/2006 Dass
7,107,860 B2 9/2006 Jones
7,226,279 B2 6/2007 Andoskin et al.
7,259,688 B2 8/2007 Hirsch et al.
7,262,532 B2 8/2007 Seidler et al.
7,275,592 B2 10/2007 Davis
7,275,711 B1 10/2007 Flanigan
7,338,262 B2 3/2008 Gozdawa
7,377,312 B2 5/2008 Davis
7,647,948 B2 1/2010 Quigley et al.
7,670,122 B2 3/2010 Phillips et al.
7,670,451 B2 3/2010 Head
7,699,099 B2 4/2010 Bolding et al.
7,730,937 B2 6/2010 Head
7,762,715 B2 7/2010 Gordon et al.
7,770,650 B2 8/2010 Young et al.
7,775,763 B1 8/2010 Johnson et al.
7,819,640 B2 10/2010 Kalavsky et al.
7,841,395 B2 11/2010 Gay et al.
7,841,826 B1 11/2010 Phillips
7,849,928 B2 12/2010 Collie
7,905,295 B2 3/2011 Mack
8,013,660 B2 9/2011 Fitzi
8,016,545 B2 9/2011 Oklejas et al.
8,066,033 B2 11/2011 Quigley et al.
8,067,865 B2 11/2011 Savant
8,197,602 B2 6/2012 Baron
8,235,126 B2 8/2012 Bradley
8,261,841 B2 9/2012 Bailey et al.
8,302,736 B1 11/2012 Olivier
8,337,142 B2 12/2012 Eslinger et al.
8,419,398 B2 4/2013 Kothnur et al.
8,506,257 B2 8/2013 Bottome
8,568,081 B2 10/2013 Song et al.
8,579,617 B2 11/2013 Ono et al.
8,771,499 B2 7/2014 McCutchen et al.
8,821,138 B2 9/2014 Holtzapple et al.
8,905,728 B2 12/2014 Blankemeier et al.
8,936,430 B2 1/2015 Bassett
8,950,476 B2 2/2015 Head
8,960,309 B2 2/2015 Davis
8,973,433 B2 3/2015 Mulford
9,080,336 B1 7/2015 Yantis
9,133,709 B2 9/2015 Huh et al.
9,157,297 B2 10/2015 Williamson, Jr.
9,200,932 B2 12/2015 Sittler
9,203,277 B2 12/2015 Kori et al.
9,234,529 B2 1/2016 Meuter
9,353,614 B2 5/2016 Roth et al.
9,383,476 B2 7/2016 Trehan
9,500,073 B2 11/2016 Alan et al.
9,540,908 B1 1/2017 Olivier
9,574,438 B2 2/2017 Flores
9,587,456 B2 3/2017 Roth
9,593,561 B2 3/2017 Xiao et al.
9,631,482 B2 4/2017 Roth et al.
9,677,560 B1 6/2017 Davis et al.
9,759,025 B2 9/2017 Vavik
9,759,041 B2 9/2017 Osborne
9,915,134 B2 3/2018 Xiao et al.
9,932,806 B2 4/2018 Stewart
9,951,598 B2 4/2018 Roth et al.
9,964,533 B2 5/2018 Ahmad
9,982,519 B2 5/2018 Melo
10,100,596 B2 10/2018 Roth et al.
10,138,885 B2 11/2018 Ejim et al.
10,151,194 B2 12/2018 Roth et al.
10,253,610 B2 4/2019 Roth et al.
10,273,399 B2 4/2019 Cox et al.
10,287,853 B2 5/2019 Ejim et al.
10,308,865 B2 6/2019 Cox et al.
10,323,644 B1 6/2019 Shakirov et al.
10,337,302 B2 7/2019 Roth et al.
10,337,312 B2 7/2019 Xiao et al.
10,378,322 B2 8/2019 Ejim et al.
10,465,477 B2 11/2019 Abdelaziz et al.
10,465,484 B2 11/2019 Turner et al.
10,487,259 B2 11/2019 Cox et al.
10,501,682 B2 12/2019 Cox et al.
10,533,558 B2 1/2020 Melo et al.
10,578,111 B2 3/2020 Xiao et al.
2002/0074742 A1 6/2002 Quoiani
2002/0079100 A1 6/2002 Simpson
2002/0109080 A1 8/2002 Tubel et al.
2002/0121376 A1 9/2002 Rivas
2002/0153141 A1 10/2002 Hartman
2003/0079880 A1 5/2003 Deaton et al.
2003/0141071 A1 7/2003 Hosie
2003/0161739 A1 8/2003 Chu et al.
2003/0185676 A1 10/2003 James
2003/0226395 A1 12/2003 Storm et al.
2004/0060705 A1 4/2004 Kelley
2005/0098349 A1 5/2005 Krueger et al.
2005/0166961 A1 8/2005 Means
2005/0217859 A1 10/2005 Hartman
2005/0254943 A1* 11/2005 Fukuchi ..... F04D 29/041 415/206
2006/0076956 A1 4/2006 Sjolie et al.
2006/0096760 A1 5/2006 Ohmer
2007/0193749 A1 8/2007 Folk
2008/0093084 A1 4/2008 Knight
2008/0187434 A1 8/2008 Neiszer
2008/0236842 A1 10/2008 Bhavsar et al.
2008/0262737 A1 10/2008 Thigpen et al.
2008/0264182 A1 10/2008 Jones
2008/0290876 A1 11/2008 Ameen
2008/0292454 A1 11/2008 Brunner
2009/0001304 A1 1/2009 Hansen et al.
2009/0016899 A1 1/2009 Davis
2009/0090513 A1 4/2009 Bissonnette
2009/0110579 A1 4/2009 Amburgey
2009/0151928 A1 6/2009 Lawson
2009/0151953 A1 6/2009 Brown
2009/0255669 A1 10/2009 Ayan et al.
2009/0289627 A1 11/2009 Johansen et al.
2009/0293634 A1 12/2009 Ong
2010/0040492 A1 2/2010 Eslinger et al.
2010/0122818 A1 5/2010 Rooks
2010/0206577 A1 8/2010 Martinez

(56) References Cited

U.S. PATENT DOCUMENTS

2010/0236794 A1 9/2010 Duan
2010/0244404 A1 9/2010 Bradley
2010/0258306 A1 10/2010 Camilleri
2010/0288493 A1 11/2010 Fielder et al.
2010/0300413 A1 12/2010 Ulrey et al.
2011/0017459 A1 1/2011 Dinkins
2011/0024107 A1 2/2011 Sunyovszky et al.
2011/0024231 A1 2/2011 Wurth et al.
2011/0036568 A1 2/2011 Barbosa
2011/0036662 A1 2/2011 Smith
2011/0155390 A1 6/2011 Lannom et al.
2011/0162832 A1 7/2011 Reid
2011/0185805 A1 8/2011 Roux et al.
2011/0203848 A1 8/2011 Krueger et al.
2011/0278094 A1 11/2011 Gute
2011/0296911 A1 12/2011 Moore
2011/0300008 A1 12/2011 Fielder et al.
2012/0012327 A1 1/2012 Plunkett et al.
2012/0282119 A1 11/2012 Floyd
2013/0019673 A1 1/2013 Sroka
2013/0300833 A1 1/2013 Perkins
2013/0048302 A1 2/2013 Gokdag et al.
2013/0051977 A1 2/2013 Song
2013/0066139 A1 3/2013 Wiessler
2013/0068454 A1 3/2013 Armistead
2013/0073208 A1 3/2013 Dorovsky
2013/0081460 A1 4/2013 Xiao et al.
2013/0175030 A1 7/2013 Ige
2013/0189123 A1 7/2013 Stokley
2013/0213663 A1 8/2013 Lau et al.
2013/0248429 A1 9/2013 Dahule
2013/0255370 A1 10/2013 Roux et al.
2013/0259721 A1 10/2013 Noui-Mehidi
2014/0012507 A1 1/2014 Trehan
2014/0014331 A1 1/2014 Crocker
2014/0027546 A1 1/2014 Kean et al.
2014/0037422 A1 2/2014 Gilarranz
2014/0041862 A1 2/2014 Ersoz
2014/0116720 A1 5/2014 He et al.
2014/0144706 A1 5/2014 Bailey et al.
2014/0209291 A1 7/2014 Watson et al.
2014/0265337 A1 9/2014 Harding et al.
2014/0341714 A1 11/2014 Casa
2014/0343857 A1 11/2014 Pfutzner
2014/0377080 A1 12/2014 Xiao et al.
2015/0068769 A1 3/2015 Xiao et al.
2015/0071795 A1 3/2015 Vazquez et al.
2015/0192141 A1 7/2015 Nowitzki et al.
2015/0204336 A1* 7/2015 McManus ..... F04D 29/086
415/203
2015/0233228 A1 8/2015 Roth
2015/0308245 A1 10/2015 Stewart et al.
2015/0308444 A1 10/2015 Trottman
2015/0330194 A1 11/2015 June et al.
2015/0354308 A1 12/2015 June et al.
2015/0354590 A1 12/2015 Kao
2015/0376907 A1 12/2015 Nguyen
2016/0010451 A1 1/2016 Melo
2016/0016834 A1 1/2016 Dahule
2016/0169231 A1 6/2016 Michelassi et al.
2016/0305447 A1 10/2016 Dreiss et al.
2016/0332856 A1 11/2016 Steedley
2017/0058664 A1 3/2017 Xiao et al.
2017/0074082 A1 3/2017 Palmer
2017/0122046 A1 5/2017 Vavik
2017/0138189 A1 5/2017 Ahmad et al.
2017/0159668 A1 6/2017 Nowitzki et al.
2017/0167498 A1 6/2017 Chang
2017/0175752 A1 6/2017 Hofer et al.
2017/0183942 A1 6/2017 Veland
2017/0194831 A1 7/2017 Marvel
2017/0292533 A1 10/2017 Zia
2017/0321695 A1 11/2017 Head
2017/0328151 A1 11/2017 Dillard
2017/0350399 A1* 12/2017 Eslinger ..... F04D 29/426
2018/0058157 A1 3/2018 Melo et al.
2018/0066671 A1 3/2018 Murugan
2018/0171763 A1 6/2018 Malbrel et al.
2018/0171767 A1 6/2018 Huynh et al.
2018/0172020 A1 6/2018 Ejim
2018/0226174 A1 8/2018 Rose
2018/0238152 A1 8/2018 Melo
2018/0306199 A1 10/2018 Reed
2018/0320059 A1 11/2018 Cox et al.
2018/0340389 A1 11/2018 Wang
2018/0363660 A1 12/2018 Klahn
2019/0032667 A1 1/2019 Ifrim et al.
2019/0040863 A1 2/2019 Davis et al.
2019/0271217 A1 9/2019 Radov et al.
2019/0368291 A1 12/2019 Xiao et al.
2020/0056462 A1 2/2020 Xiao et al.
2020/0056615 A1 2/2020 Xiao et al.

FOREIGN PATENT DOCUMENTS

CN 2168104 6/1994
CN 1507531 6/2004
CN 101328769 12/2008
CN 101842547 9/2010
CN 202851445 4/2013
CN 103185025 7/2013
CN 203420906 2/2014
CN 104141633 11/2014
CN 104533797 4/2015
CN 103835988 1/2016
CN 105239963 1/2016
CN 103717901 6/2016
DE 2260678 6/1974
DE 3022241 12/1981
DE 3444859 6/1985
DE 3520884 1/1986
DE 19654092 7/1998
DE 10307887 10/2004
DE 10346647 A1 * 5/2005 ..... F04D 29/047
DE 102007005426 5/2008
DE 102008001607 11/2009
DE 102008054766 6/2010
DE 102012215023 1/2014
DE 102012022453 5/2014
DE 102013200450 7/2014
DE 102012205757 8/2014
EP 0579981 1/1994
EP 0637675 2/1995
EP 1101024 5/2001
EP 1143104 10/2001
EP 1270900 1/2003
EP 1369588 12/2003
EP 2801696 12/2014
EP 2893301 5/2018
EP 3527830 8/2019
GB 670206 4/1952
GB 2173034 10/1986
GB 2226776 7/1990
GB 2283035 4/1995
GB 2348674 10/2000
GB 2477909 8/2011
GB 2504104 1/2014
JP 4019375 1/1992
JP 2005076486 3/2005
JP 2013110910 6/2013
RU 98500 10/2010
RU 122531 11/2012
RU 178531 4/2018
WO WO 1995004869 2/1995
WO WO 1998046857 10/1998
WO WO 1999027256 6/1999
WO WO 2002072998 9/2002
WO WO 2005066502 7/2005
WO WO 2009113894 9/2009
WO WO 2009129607 10/2009
WO WO 2011066050 6/2011
WO WO 2011101296 8/2011
WO WO 2011133620 10/2011
WO WO 2011135541 11/2011

(56) References Cited

FOREIGN PATENT DOCUMENTS

| | | | |
|---|---|---|---|
| WO | WO 2012058290 | 5/2012 | |
| WO | WO 2012166638 | 12/2012 | |
| WO | WO 2013089746 | 6/2013 | |
| WO | WO 2013171053 | 11/2013 | |
| WO | WO 2014127035 | 8/2014 | |
| WO | WO 2014147645 | 9/2014 | |
| WO | WO 2015034482 | 3/2015 | |
| WO | WO 2015041655 | 3/2015 | |
| WO | WO 2015084926 | 6/2015 | |
| WO | WO 2015123236 | 8/2015 | |
| WO | WO 2016003662 | 1/2016 | |
| WO | WO 2016012245 | 1/2016 | |
| WO | WO 2016050301 | 4/2016 | |
| WO | WO 2016081389 | 5/2016 | |
| WO | WO 2016089526 | 6/2016 | |
| WO | WO 2016160016 | 10/2016 | |
| WO | WO 2016195643 | 12/2016 | |
| WO | WO 2017021553 | 2/2017 | |
| WO | WO 2018022198 | 2/2018 | |
| WO | WO 2018096345 | 5/2018 | |
| WO | WO 2019243789 | 12/2019 | |
| WO | WO 2020165046 | 8/2020 | |
| WO | WO-2020165046 A1 * | 8/2020 | ..... F04D 29/026 |

OTHER PUBLICATIONS

Abelsson et al., "Development and Testing of a Hybrid Boosting Pump," OTC 21516, Offshore Technology Conference (OTC), presented at the Offshore Technology Conference, May 2-5, 2011, 9 pages.

Alhanati et al., "ESP Failures: Can we talk the same language?" Society of Petroleum Engineers (SPE), SPE paper, SPE ESP Workshop held in Houston, Apr. 25-27, 2001, 11 page.

Alhasan et al., "Extending mature field production life using a multiphase twin screw pump," BHR Group Multiphase 15, 2011, 11 pages.

BakerHughes.com, [online], "Multiphase Pump: Increases Efficiency and Production in Wells with High Gas Content," Brochure overview, retrieved from URL <https://assets.www.bakerhughes.com/system/69/00d970d9dd11e3a411ddf3c1325ea6/28592.MVP_Overview.pdf>, 2014, 2 pages.

Blunt, "Effects of heterogeneity and wetting on relative permeability using pore level modeling," SPE 36762, Society of Petroleum Engineers (SPE), SPE Journal 2:01 (70-87), Mar. 1997, 19 pages.

Bryant and Blunt, "Prediction of relative permeability in simple porous media," Physical Review A 46:4, Aug. 1992, 8 pages.

Champion et al., "The application of high-power sound waves for wellbore cleaning," SPE 82197, Society of Petroleum Engineers International (SPE), presented at the SPE European Formation Damage Conference, May 13-14, 2003, 10 pages.

Chappell and Lancaster, "Comparison of methodological uncertainties within permeability measurements," Wiley InterScience, Hydrological Processes 21:18 (2504-2514), Jan. 2007, 11 pages.

Cramer et al., "Development and Application of a Downhole Chemical Injection Pump for Use in ESP Applications," SPE 14403, Society of Petroleum Engineers (SPE), presented at the 66th Annual Technical Conference and Exhibition, Sep. 22-25, 1985, 6 page.

Danfoss, "Facts Worth Knowing about Frequency Converters," Handbook VLT Frequency Converters, Danfoss Engineering Tomorrow, 180 pages.

DiCarlo et al., "Three-phase relative permeability of water-wet, oil-wet, and mixed-wet sandpacks," SPE 60767, Society of Petroleum Engineers (SPE), presented at the 1998 SPE Annual Technical Conference and Exhibition, Sep. 27-30, 1998, SPE Journal 5:01 (82-91), Mar. 2000, 10 pages.

Dixit et al., "A pore-level investigation of relative permeability hysteresis in water-wet systems," SPE 37233, Society of Petroleum Engineers (SPE), presented at the 1997 SPE International Symposium on Oilfield Chemistry, Feb. 18-21, 1997, SPE Journal 3:02 (115-123), Jun. 1998, 9 pages.

ejprescott.com [online], "Water, Sewer and Drain Fittings B-22, Flange Adaptors," retrieved from URL <https://www.ejprescott.com/media/reference/FlangeAdaptorsB-22.pdf> retrieved on Jun. 15, 2020, available on or before Nov. 2010 via wayback machine URL <http://web.archive.org/web/20101128181255/https://www.ejprescott.com/media/reference/FlangeA daptorsB-22.pdf>, 5 pages.

Fatt, "The network model of porous media," SPE 574-G, Society of Petroleum Engineers (SPE), I. Capillary Pressure Characteristics, AIME Petroleum Transactions 207: 144-181, Dec. 1956, 38 pages.

Geary et al., "Downhole Pressme Boosting in Natural Gas Wells: Results from Prototype Testing," SPE 11406, Society of Petroleum Engineers International (SPE), presented at the SPE Asia Pacific Oil and Gas Conference and Exhibition, Oct. 20-22, 2008, 13 pages.

Godbole et al., "Axial Thrust in Centrifugal Pumps—Experimental Analysis," Paper Ref: 2977, presented at the 15th International Conference on Experimental Mechanics, ICEM15, Jul. 22-27, 2012, 14 pages.

Heiba et al., "Percolation theory of two-phase relative permeability," Society of Petroleum Engineers (SPE), SPE Reservoir Engineering 7:01 (123-132), Feb. 1992, 11 pages.

Hua et al., "Comparison of Multiphase Pumping Techniques for Subsea and Downhole Applications," SPE 146784, Society of Petroleum Engineers International (SPE), presented at the SPE Annual Technical Conference and Exhibition, Oct. 30-Nov. 2, 2011, Oil and Gas Facilities, Feb. 2012, 11 pages.

Hui and Blunt, "Effects of wettability on three-phase flow in porous media" American Chemical Society (ACS), J. Phys. Chem. 104 :16 (3833-3845), Feb. 2000, 13 pages.

Krag et al., "Preventing Scale Deposition Downhole Using High Frequency Electromagnetic AC Signals from Surface Enhance Production Offshore Denmark," SPE-170898-MS, Society of Petroleum Engineers International (SPE), presented at the SPE Annual Technical Conference and Exhibition, Oct. 27-29, 2014, 10 pages.

laserfocusworld.com [online], "High-Power Lasers: Fiber lasers drill for oil," Dec. 5, 2012, retrieved on May 31, 2018, retrieved from URL: <https://www.laserfocusworld.com/articles/print/volume-48/issue-12/world-news/high-power-lasers-fiber-lasers-drill-for-oil.html>, 4 pages.

Li et al., "In Situ Estimation of Relative Permeability from Resistivity Measurements," EAGE/The Geological Society of London, Petroleum Geoscience 20: 143-151, 2014, 10 pages.

machinedesign.com [online], Frances Richards, "Motors for efficiency: Permanent-magnet, reluctance, and induction motors compared," Apr. 2013, retrieved on Nov. 11, 2020, retrieved from URL <https://www.machinedesign.com/motors-drives/article/21832406/motors-for-efficiency-permanentmagnet-reluctance-and-induction-motors-compared>.

Mahmud et al., "Effect of network topology on two-phase imbibition relative permeability," Transport in Porous Media 66:3 (481-493), Feb. 2007, 14 pages.

Mirza, "The Next Generation of Progressive Cavity Multiphase Pumps use a Novel Design Concept for Superior Performance and Wet Gas Compression," Flow Loop Testing, BHR Group, 2007, 9 pages.

Mirza, "Three Generations of Multiphase Progressive Cavity Pumping," Cahaba Media Group, Upstream Pumping Solutions, Winter 2012, 6 pages.

Muswar et al., "Physical Water Treatment in the Oil Field Results from Indonesia," SPE 113526, Society of Petroleum Engineers International (SPE), presented at the SPE Asia Pacific Oil and Gas Conference and Exhibition, Oct. 18-20, 2010, 11 pages.

Nagy et al., "Comparison of permeability testing methods," Proceedings of the 18th International Conference on Soil Mechanics and Geotechnical Engineering 399-402, 2013, 4 pages.

Parker, "About Gerotors," Parker Haffinfin Corp, 2008, 2 pages.

Purcell, "Capillary pressures—their measurement using mercury and the calculation of permeability therefrom," Petroleum Transactions, AIME, presented at the Branch Fall Meeting, Oct. 4-6, 1948, Journal of Petroleum Technology 1:02 (39-48), Feb. 1949, 10 pages.

Rzeznik et al., "Two Year Results of a Breakthrough Physical Water Treating System for the Control of Scale in Oilfield Applications,"

(56) References Cited

OTHER PUBLICATIONS

SPE114072, Society of Petroleum Engineers International (SPE), presented at the 2008 SPE International Oilfield Scale Conference, May 28-29, 2008, 11 pages.
Schöneberg, "Wet Gas Compression with Twin Screw Pumps," Bornemann Pumps, Calgary Pump Symposium 2005, 50 pages.
Simpson et al., "A Touch, Truly Multiphase Downhole Pump for Unconventional Wells," SPE-185152-MS, Society of Petroleum Engineers (SPE), presented at the SPE Electric Submersible Pump Symposium, the Woodlands, Texas, Apr. 24-28, 2017, 20 pages.
slb.com [online], "AGH: Advanced Gas-Handling Device," Product Sheet, retrieved from URL: <http://www.slb.com/~/media/Files/artificial_lift/product_sheets/ESPs/advanced_gas_handling_ps.pdf>. Jan. 2014, 2 pages.
Sulzer Technical Review, "Pushing the Boundaries of Centrifugal Pump Design," Oil and Gas, Jan. 2014, 2 pages.
tm4.com [online], "Outer rotor for greater performance," available on or before Dec. 5, 2017, via internet archive: Wayback Machine URL <https://web.archive.org/web/20171205163856/https://www.tm4.com/technology/electric-motors/external-rotor-motor-technology/>, retrieved on May 17, 2017, retrieved from URL <https://www.tm4.com/technology/electric-motors/external-rotor-motor-technology/>, 2 pages.
Wylde et al., "Deep Downhole Chemical Injection on BP-Operated Miller: Experience and Learning," SPE 92832, Society of Petroleum Engineers (SPE), presented at the 2005 SPE International Symposium on Oilfield Chemistry, May 11-12, 2005, SPE Production & Operations, May 2006, 6 pages.
Xiao et al., "Induction Versus Permanent Magnet Motors for ESP Applications," SPE-192177-MS, Society of Petroleum Engineers (SPE), presented at the SPE Kingdom of Saudi Arabia Annual Technical Symposium and Exhibition, Apr. 23-26, 2018, 15 pages.
Zhan et al., "Characterization of Reservoir Heterogeneity Through Fluid Movement Monitoring with Deep Electromagnetic and Pressure Measurements," SPE 116328, Society of Petroleum Engineers International (SPE), presented at the 2008 SPE Annual Technical Conference and Exhibition, Sep. 21-24, 2008, 16 pages.

* cited by examiner

SELF-BALANCING THRUST DISK

TECHNICAL FIELD

This disclosure relates to rotating equipment, for example, rotating equipment used in wellbores.

BACKGROUND

Artificial lift can be employed in wells to boost production of fluid to the Earth's surface. Electric submersible pumps (ESPs) are commonly used to provide artificial lift. As components of an ESP rotate, axial loads are generated. In some cases, ESPs include a protector that can support the thrust loads of the ESP. The protector can also provide other various functions, such as protecting a motor from well fluid, pressure equalization between the motor and the wellbore, and transmitting power from the motor to the ESP.

SUMMARY

Certain aspects of the subject matter described can be implemented as a thrust balancing apparatus for a pump. The apparatus includes a housing, a balancing chamber, a connecting tube, a balancing disk, a bushing, a washer, and a pair of upthrust washers. The balancing chamber is coupled to and disposed within the housing. The balancing chamber defines an upper cavity and a lower cavity. The connecting tube is coupled to the balancing chamber and the housing. The connecting tube is configured to establish fluid communication between the balancing chamber and an exterior of the housing, such that an interior of the balancing chamber is exposed to fluid surrounding the housing. The balancing disk is coupled to and surrounds a rotatable shaft of the pump. The rotatable shaft passes through the balancing chamber. A first portion of the balancing disk is disposed within the upper cavity of the balancing chamber. A second portion of the balancing disk passes through the lower cavity of the balancing chamber. A third portion of the balancing disk is external to the balancing chamber. The bushing is disposed within the housing and surrounds the rotatable shaft. The washer surrounds the rotatable shaft. The washer is disposed within the housing between the third portion of the balancing disk and the bushing. The pair of upthrust washers surrounds the third portion of the balancing disk. The pair of upthrust washers is disposed within the housing between the third portion of the balancing disk and the balancing chamber.

This, and other aspects, can include one or more of the following features.

In some implementations, the pump is an electric submersible pump that operates free of a protector. In some implementations, the housing is positioned downstream of a pump stage of the electric submersible pump.

In some implementations, the first portion of the balancing disk includes a first disk. In some implementations, the second portion of the balancing disk is tubular. In some implementations, the third portion of the balancing disk includes a second disk.

In some implementations, the washer is axially disposed between the bushing and the second disk of the third portion of the balancing disk. In some implementations, the pair of upthrust washers is axially disposed between the balancing chamber and the second disk of the third portion of the balancing disk.

In some implementations, the connecting tube is coupled to the upper cavity of the balancing chamber.

In some implementations, the upper cavity and the lower cavity of the balancing chamber are partitioned by a ring lining an inner circumferential wall of the balancing chamber. In some implementations, the second portion of the balancing disk passes through the ring.

In some implementations, a first spacing is defined between the ring and the first disk of the first portion of the balancing disk. In some implementations, a second spacing is defined between the pair of upthrust washers. In some implementations, the first spacing and the second spacing are adjustable to balance a thrust load of the rotatable shaft.

In some implementations, the apparatus includes a seal surrounding the rotatable shaft. In some implementations, the seal is radially disposed between the rotatable shaft and the balancing chamber. In some implementations, the seal is configured to prevent fluid flow between the upper cavity of the balancing chamber and an interior of the housing.

Certain aspects of the subject matter described can be implemented as a system. The system includes an electric submersible pump (ESP) and a thrust balancing apparatus. The ESP is independent of a protector. The ESP includes multiple pump stages and a rotatable shaft. The thrust balancing apparatus is located downstream of the pump stages of the ESP. The thrust balancing apparatus includes a housing, a balancing chamber, a connecting tube, a balancing disk, a bushing, a washer, and a pair of upthrust washers. The balancing chamber is coupled to and disposed within the housing. The balancing chamber defines an upper cavity and a lower cavity. The connecting tube is coupled to the balancing chamber and the housing. The connecting tube is configured to establish fluid communication between the balancing chamber and an exterior of the housing, such that an interior of the balancing chamber is exposed to fluid surrounding the housing. The balancing disk is coupled to and surrounds the rotatable shaft. The rotatable shaft passes through the balancing chamber. A first portion of the balancing disk is disposed within the upper cavity of the balancing chamber. A second portion of the balancing disk passes through the lower cavity of the balancing chamber. A third portion of the balancing disk is external to the balancing chamber. The bushing is disposed within the housing and surrounds the rotatable shaft. The washer surrounds the rotatable shaft. The washer is disposed within the housing between the third portion of the balancing disk and the bushing. The pair of upthrust washers surrounds the third portion of the balancing disk. The pair of upthrust washers is disposed within the housing between the third portion of the balancing disk and the balancing chamber.

This, and other aspects, can include one or more of the following features.

In some implementations, the first portion of the balancing disk includes a first disk. In some implementations, the second portion of the balancing disk is tubular. In some implementations, the third portion of the balancing disk includes a second disk.

In some implementations, the washer is axially disposed between the bushing and the second disk of the third portion of the balancing disk. In some implementations, the pair of upthrust washers is axially disposed between the balancing chamber and the second disk of the third portion of the balancing disk.

In some implementations, the connecting tube is coupled to the upper cavity of the balancing chamber.

In some implementations, the upper cavity and the lower cavity of the balancing chamber are partitioned by a ring lining an inner circumferential wall of the balancing chamber. In some implementations, the second portion of the balancing disk passes through the ring.

In some implementations, a first spacing is defined between the ring and the first disk of the first portion of the balancing disk. In some implementations, a second spacing is defined between the pair of upthrust washers. In some implementations, the first spacing and the second spacing are adjustable to balance a thrust load of the rotatable shaft.

In some implementations, the thrust balancing apparatus includes a seal surrounding the rotatable shaft. In some implementations, the seal is radially disposed between the rotatable shaft and the balancing chamber. In some implementations, the seal is configured to prevent fluid flow between the upper cavity of the balancing chamber and an interior of the housing.

Certain aspects of the subject matter described can be implemented as a method. Fluid communication between a balancing chamber and an exterior of a housing is established by a connecting tube coupled to the balancing chamber and the housing, thereby exposing an interior of the balancing chamber to fluid surrounding the housing. The balancing chamber is coupled to and disposed within the housing. The balancing chamber defines an upper cavity and a lower cavity. Pressure within the balancing chamber is balanced by adjusting a first spacing. A balancing disk is coupled to and surrounds a rotatable shaft passing through the balancing chamber. A ring lining an inner circumferential wall of the balancing chamber partitions the balancing chamber into the upper cavity and the lower cavity. The first spacing is defined between the balancing disk and the ring. Pressure between the balancing chamber and the housing is balanced by adjusting a second spacing. A pair of upthrust washers surrounds the balancing disk and is disposed within the housing between the balancing disk and the balancing chamber. The second spacing is defined between the pair of upthrust washers. Balancing pressure within the balancing chamber and balancing pressure between the balancing chamber and the housing results in balancing a thrust load of the rotatable shaft while the rotatable shaft rotates.

This, and other aspects, can include one or more of the following features.

In some implementations, the balancing disk includes a first portion, a second portion, and a third portion. In some implementations, the first portion includes a first disk disposed within the upper cavity of the balancing chamber. In some implementations, the second portion is tubular and passes through the lower cavity of the balancing chamber. In some implementations, the third portion includes a second disk that is external to the balancing chamber. In some implementations, the pair of upthrust washers is disposed axially in between the balancing chamber and the second disk of the third portion of the balancing disk. In some implementations, adjusting the second spacing includes adjusting an axial spacing between the pair of upthrust washers.

In some implementations, the connecting tube is coupled to the upper cavity of the balancing chamber. In some implementations, establishing fluid communication between the balancing chamber and the exterior of the housing includes establishing fluid communication between the upper cavity of the balancing chamber and the exterior of the housing.

In some implementations, fluid flow is prevented between the upper cavity of the balancing chamber and an interior of the housing by a seal that surrounds the rotatable shaft and is radially disposed between the rotatable shaft and the balancing chamber.

The details of one or more implementations of the subject matter of this disclosure are set forth in the accompanying drawings and the description. Other features, aspects, and advantages of the subject matter will become apparent from the description, the drawings, and the claims.

DETAILED DESCRIPTION

Figure 1:
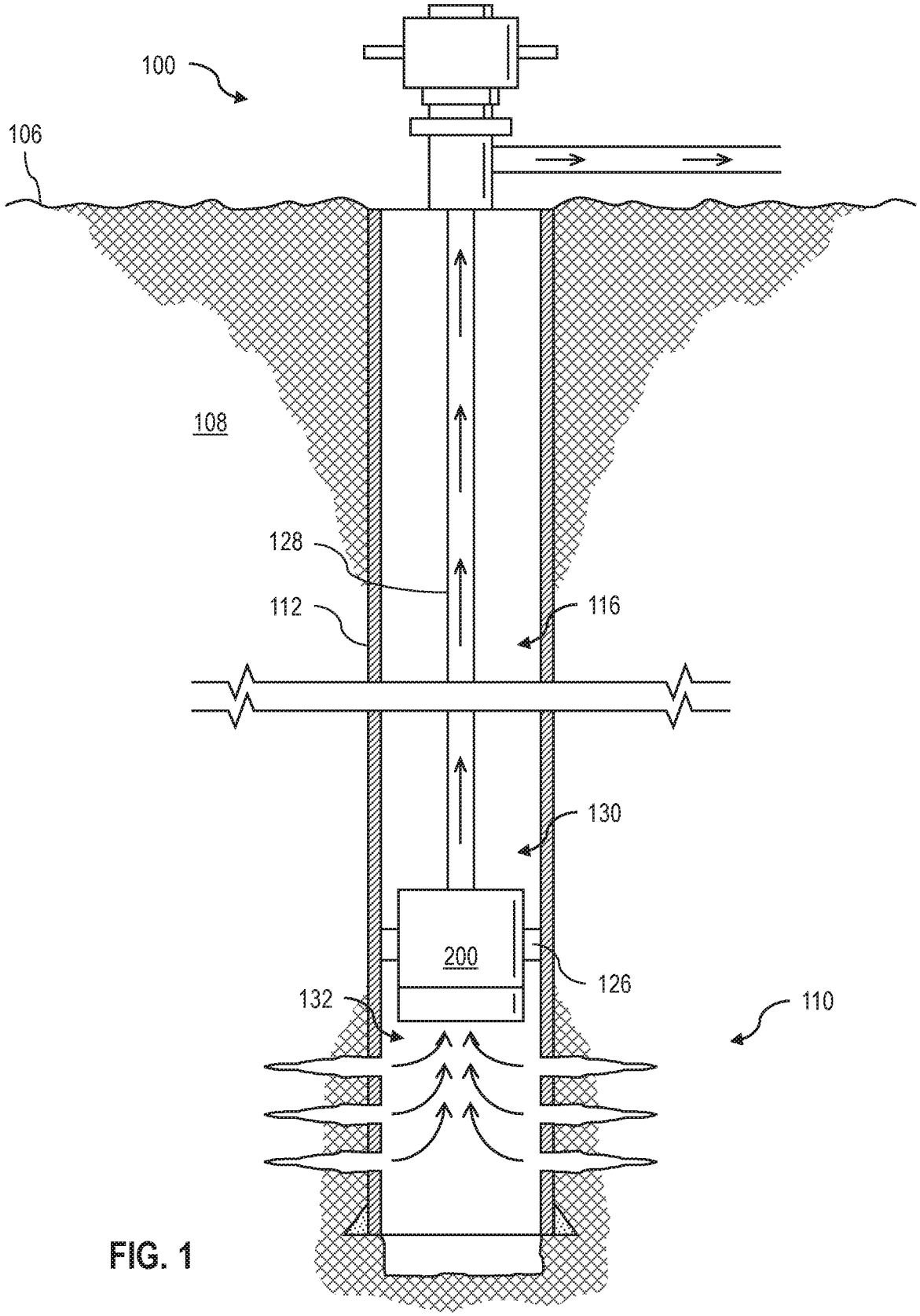
FIG. 1 is a schematic diagram of an example well.

This disclosure describes technologies relating to balancing thrust loads in rotating equipment, and in particular, in protector-less electric submersible pumps (ESPs). ESP systems typically include a centrifugal pump, a protector, a power delivery cable, a motor, and a monitoring tool. The pump can transfer fluid from one location to another. For example, the pump provides artificial lift in a well to boost fluid production from the well. The pump can include multiple pump stages which include impellers and diffusers. The rotating impeller can provide energy to the well fluid, and the stationary diffuser can convert the kinetic energy of the fluid into head (pressure) to facilitate fluid flow. In some cases, pump stages are stacked in series to form a multi-stage pump that is housed within a pump housing. The motor can provide mechanical power to drive a rotatable shaft of the pump. The power delivery cable can supply electrical power to the motor from the surface. The protector can support thrust loads from the pump, transmit power from the motor to the pump, equalize pressure (for example, between the motor and the wellbore within which the ESP resides), provide motor oil to or receive motor oil from the motor according to changes in operating temperature, and prevent well fluid from entering the motor. The monitoring tool can be installed on the motor to measure parameters, such as pump intake and discharge pressures, motor oil and winding temperatures, and vibration. The monitoring tool can transmit measured data to the surface, for example, via the power delivery cable.

In some cases, however, it can be desirable to remove the protector from the artificial lift system because the protector can be prone to various problems that may lead to frequent operational failures of the artificial lift system. The subject matter described in this disclosure can be implemented in particular implementations, so as to realize one or more of the following advantages. The artificial system is configured to operate without the use of a protector. The thrust balancing apparatus included in the artificial lift can fully support the thrust loads of the ESP (that is, develop zero residual thrust) at a range of operating conditions (for example, a range of operating speeds and flow rates) as opposed to a single design point. In contrast, conventional thrust balancing disks can provide full support of the thrust loads of the ESP at a particular design point, and auxiliary components help support residual thrust loads whenever the ESP operates away from the design point. The thrust balancing apparatus described can have similar or the same outer dimensions of a pump stage of an ESP. The thrust balancing apparatus described can be implemented in artificial lift systems in which solid and/or abrasive particles are expected in the well fluid without detrimental effect on functionality of the artificial system. The thrust balancing apparatus described can operate free of lubrication. The thrust balancing apparatus described can improve reliability and extend operating life of artificial lift systems.

FIG. 1 depicts an example well 100 constructed in accordance with the concepts herein. The well 100 extends from the surface 106 through the Earth 108 to one more subterranean zones of interest 110 (one shown). The well 100 enables access to the subterranean zones of interest 110 to allow recovery (that is, production) of fluids to the surface 106 (represented by flow arrows in FIG. 1) and, in some implementations, additionally or alternatively allows fluids to be placed in the Earth 108. In some implementations, the subterranean zone 110 is a formation within the Earth 108 defining a reservoir, but in other instances, the zone 110 can be multiple formations or a portion of a formation. The subterranean zone can include, for example, a formation, a portion of a formation, or multiple formations in a hydrocarbon-bearing reservoir from which recovery operations can be practiced to recover trapped hydrocarbons. In some implementations, the subterranean zone includes an underground formation of naturally fractured or porous rock containing hydrocarbons (for example, oil, gas, or both). In some implementations, the well can intersect other types of formations, including reservoirs that are not naturally fractured. For simplicity's sake, the well 100 is shown as a vertical well, but in other instances, the well 100 can be a deviated well with a wellbore deviated from vertical (for example, horizontal or slanted), the well 100 can include multiple bores forming a multilateral well (that is, a well having multiple lateral wells branching off another well or wells), or both.

In some implementations, the well 100 is a gas well that is used in producing hydrocarbon gas (such as natural gas) from the subterranean zones of interest 110 to the surface 106. While termed a "gas well," the well need not produce only dry gas, and may incidentally or in much smaller quantities, produce liquid including oil, water, or both. In some implementations, the well 100 is an oil well that is used in producing hydrocarbon liquid (such as crude oil) from the subterranean zones of interest 110 to the surface 106. While termed an "oil well," the well not need produce only hydrocarbon liquid, and may incidentally or in much smaller quantities, produce gas, water, or both. In some implementations, the production from the well 100 can be multiphase in any ratio. In some implementations, the production from the well 100 can produce mostly or entirely liquid at certain times and mostly or entirely gas at other times. For example, in certain types of wells it is common to produce water for a period of time to gain access to the gas in the subterranean zone. The concepts herein, though, are not limited in applicability to gas wells, oil wells, or even production wells, and could be used in wells for producing other gas or liquid resources or could be used in injection wells, disposal wells, or other types of wells used in placing fluids into the Earth.

The wellbore of the well 100 is typically, although not necessarily, cylindrical. All or a portion of the wellbore is lined with a tubing, such as casing 112. The casing 112 connects with a wellhead at the surface 106 and extends downhole into the wellbore. The casing 112 operates to isolate the bore of the well 100, defined in the cased portion of the well 100 by the inner bore 116 of the casing 112, from the surrounding Earth 108. The casing 112 can be formed of a single continuous tubing or multiple lengths of tubing joined (for example, threadedly) end-to-end. In FIG. 1, the casing 112 is perforated in the subterranean zone of interest 110 to allow fluid communication between the subterranean zone of interest 110 and the bore 116 of the casing 112. In some implementations, the casing 112 is omitted or ceases in the region of the subterranean zone of interest 110. This portion of the well 100 without casing is often referred to as "open hole."

The wellhead defines an attachment point for other equipment to be attached to the well 100. For example, FIG. 1 shows well 100 being produced with a Christmas tree attached to the wellhead. The Christmas tree includes valves used to regulate flow into or out of the well 100. The well 100 also includes a system 200 residing in the wellbore, for example, at a depth that is nearer to subterranean zone 110 than the surface 106. The system 200, being of a type configured in size and robust construction for installation within a well 100, can include any type of rotating equipment that can assist production of fluids to the surface 106 and out of the well 100 by creating an additional pressure differential within the well 100. For example, the system 200 can include a pump, compressor, blower, or multi-phase fluid flow aid.

In particular, casing 112 is commercially produced in a number of common sizes specified by the American Petroleum Institute (the "API"), including 4½, 5, 5½, 6, 6⅝, 7, 7⅝, 7¾, 8⅝, 8¾, 9⅝, 9¾, 9⅞, 10¾, 11¾, 11⅞, 13⅜, 13½, 13⅝, 16, 18⅝, and 20 inches, and the API specifies internal diameters for each casing size. The system 200 can be configured to fit in, and (as discussed in more detail below) in certain instances, seal to the inner diameter of one of the specified API casing sizes. Of course, the system 200 can be made to fit in and, in certain instances, seal to other sizes of casing or tubing or otherwise seal to a wall of the well 100.

Additionally, the construction of the components of the system 200 are configured to withstand the impacts, scraping, and other physical challenges the system 200 will encounter while being passed hundreds of feet/meters or even multiple miles/kilometers into and out of the well 100. For example, the system 200 can be disposed in the well 100 at a depth of up to 20,000 feet (6,096 meters). Beyond just a rugged exterior, this encompasses having certain portions of any electronics being ruggedized to be shock resistant and remain fluid tight during such physical challenges and during operation. Additionally, the system 200 is configured to withstand and operate for extended periods of time (for example, multiple weeks, months or years) at the pressures and temperatures experienced in the well 100, which temperatures can exceed 400 degrees Fahrenheit (° F.)/205 degrees Celsius (° C.) and pressures over 2,000 pounds per square inch gauge (psig), and while submerged in the well fluids (gas, water, or oil as examples). Finally, the system 200 can be configured to interface with one or more of the common deployment systems, such as jointed tubing (that is, lengths of tubing joined end-to-end), a sucker rod, coiled tubing (that is, not-jointed tubing, but rather a continuous, unbroken and flexible tubing formed as a single piece of material), or wireline with an electrical conductor (that is, a monofilament or multifilament wire rope with one or more electrical conductors, sometimes called e-line) and thus have a corresponding connector (for example, a jointed tubing connector, coiled tubing connector, or wireline connector).

A seal system 126 is integrated or provided separately with a downhole system, as shown with the system 200, divides the well 100 into an uphole zone 130 above the seal system 126 and a downhole zone 132 below the seal system 126. In some implementations, the seal system 126 is integrated with a tubing (such as tubing 128) uphole of the system 200. FIG. 1 shows the system 200 positioned in the open volume of the bore 116 of the casing 112, and connected to a production string of tubing (also referred as production tubing 128) in the well 100. The wall of the well 100 includes the interior wall of the casing 112 in portions of the wellbore having the casing 112, and includes the open hole wellbore wall in uncased portions of the well 100. Thus, the seal system 126 is configured to seal against the wall of the wellbore, for example, against the interior wall of the casing 112 in the cased portions of the well 100 or against the interior wall of the wellbore in the uncased, open hole portions of the well 100. In certain instances, the seal system 126 can form a gas- and liquid-tight seal at the pressure differential the system 200 creates in the well 100. For example, the seal system 126 can be configured to at least partially seal against an interior wall of the wellbore to separate (completely or substantially) a pressure in the well 100 downhole of the seal system 126 from a pressure in the well 100 uphole of the seal system 126. Although not shown in FIG. 1, additional components, such as a surface compressor, can be used in conjunction with the system 200 to boost pressure in the well 100.

In some implementations, the system 200 can be implemented to alter characteristics of a wellbore by a mechanical intervention at the source. Alternatively, or in addition to any of the other implementations described in this specification, the system 200 can be implemented as a high flow, low pressure rotary device for gas flow in wells. Alternatively, or in addition to any of the other implementations described in this specification, the system 200 can be implemented in a direct well-casing deployment for production through the wellbore. Other implementations of the system 200 as a pump, compressor, or multiphase combination of these can be utilized in the well bore to effect increased well production.

The system 200 locally alters the pressure, temperature, flow rate conditions, or a combination of these of the fluid in the well 100 proximate the system 200. In certain instances, the alteration performed by the system 200 can optimize or help in optimizing fluid flow through the well 100. As described previously, the system 200 creates a pressure differential within the well 100, for example, particularly within the locale in which the system 200 resides. In some instances, the system 200 introduced to the well 100 adjacent the perforations can reduce the pressure in the well 100 near the perforations to induce greater fluid flow from the subterranean zone 110, increase a temperature of the fluid entering the system 200 to reduce condensation from limiting production, increase a pressure in the well 100 uphole of the system 200 to increase fluid flow to the surface 106, or a combination of these.

The system 200 moves the fluid at a first pressure downhole of the system 200 to a second, higher pressure uphole of the system 200. The system 200 can operate at and maintain a pressure ratio across the system 200 between the second, higher uphole pressure and the first, downhole pressure in the wellbore. The pressure ratio of the second pressure to the first pressure can also vary, for example, based on an operating speed of the system 200.

The system 200 can operate in a variety of downhole conditions of the well 100. For example, the initial pressure within the well 100 can vary based on the type of well, depth of the well 100, and production flow from the perforations into the well 100. In some examples, the pressure in the well 100 proximate a bottomhole location is sub-atmospheric, where the pressure in the well 100 is at or below about 14.7 pounds per square inch absolute (psia), or about 101.3 kiloPascal (kPa). The system 200 can operate in sub-atmospheric well pressures, for example, at well pressure between 2 psia (13.8 kPa) and 14.7 psia (101.3 kPa). In some examples, the pressure in the well 100 proximate a bottomhole location is much higher than atmospheric, where the pressure in the well 100 is above about 14.7 pounds per square inch absolute (psia), or about 101.3 kiloPascal (kPa). The system 200 can operate in above atmospheric well pressures, for example, at well pressure between 14.7 psia (101.3 kPa) and 5,000 psia (34,474 kPa).

Figure 2A:
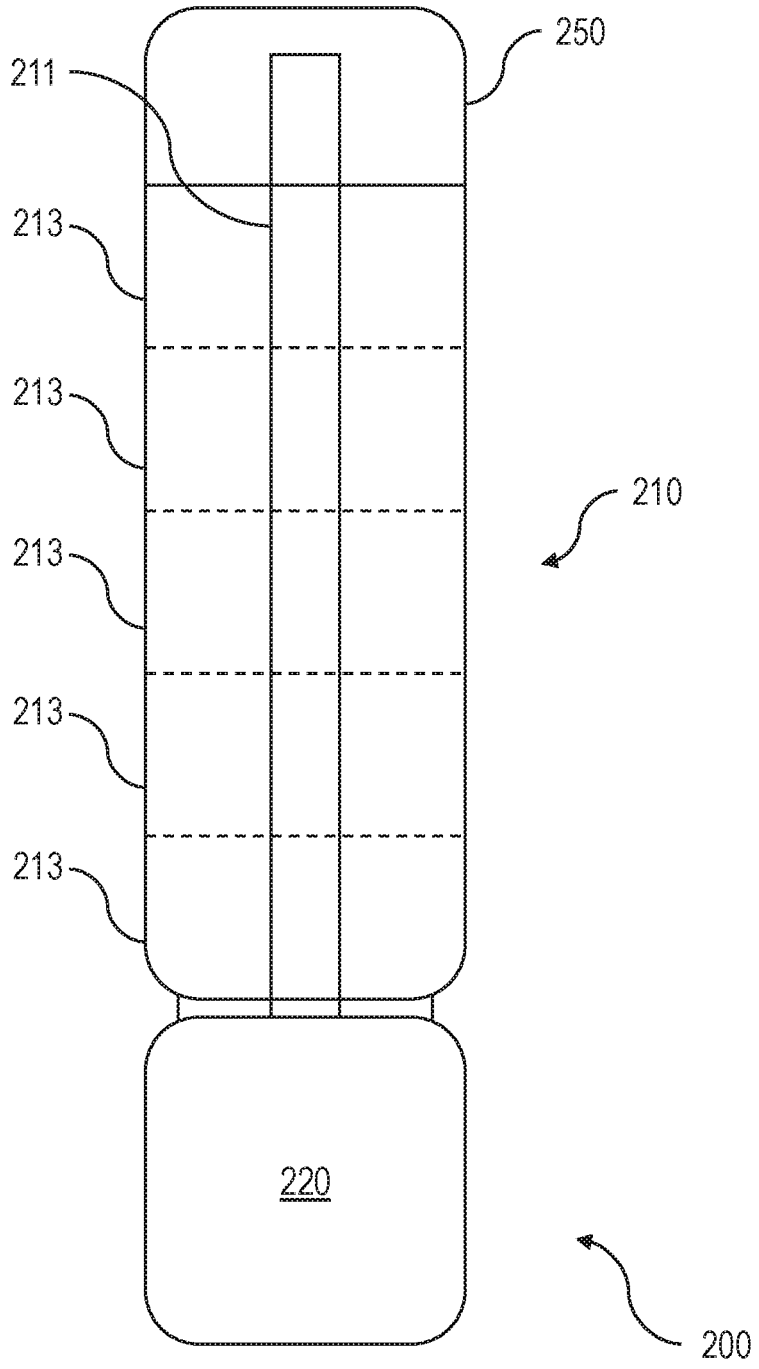
FIG. 2A is a schematic diagram of an example system that can be implemented in the well of FIG. 1.
Figure 2B:
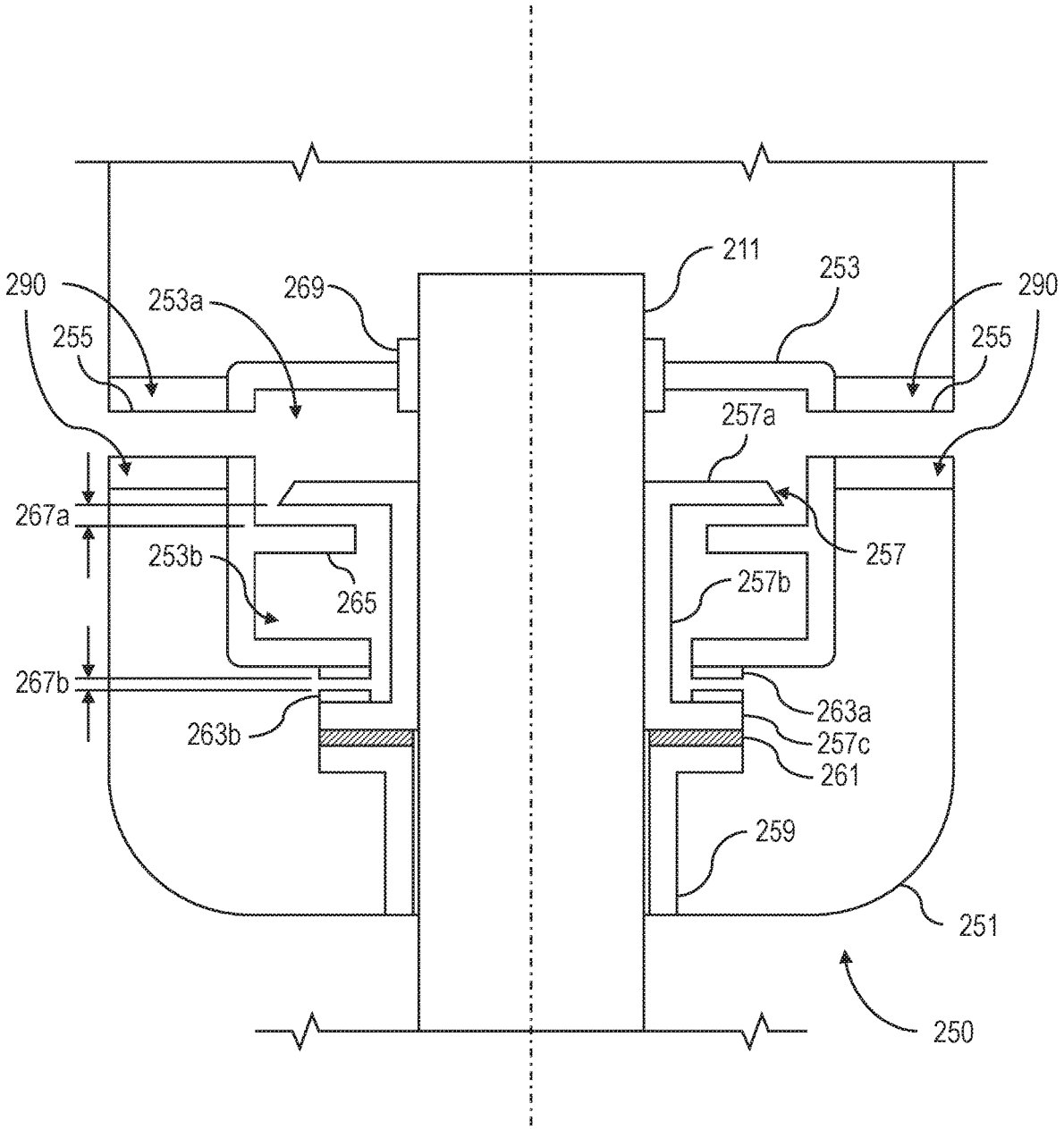
FIG. 2B is a schematic diagram of an example apparatus that can be implemented in the system of FIG. 2A.

FIG. 2A is a schematic diagram of an implementation of the system 200, which can provide artificial lift within a wellbore, such as within the wellbore of the well 100. The system 200 includes an ESP 210, a motor 220, and a thrust balancing apparatus 250. In some implementations, the system 200 includes a different rotating equipment from the ESP 210, such as a blower or a compressor. In some implementations, the ESP 210 includes a rotatable shaft 211 and multiple pump stages 213. Each pump stage includes an impeller and a diffuser that cooperate to generate head, thereby facilitating fluid flow. The impellers of the ESP 210 can be fixed or floating. The impellers of the ESP 210 can be radial flow impellers, axial flow impellers, or mixed flow impellers. In some implementations, the motor 220 is positioned upstream relative to the ESP 210. In some implementations, the thrust balancing apparatus 250 is positioned downstream relative to the ESP 210. For example, the thrust balancing apparatus 250 can be positioned downstream of the downstream-most pump stage 213 of the ESP 210. The thrust balancing apparatus 250 is also shown in FIG. 2B and described in more detail later. As used in this disclosure, the terms "upstream" and "downstream" are in relation to general direction of fluid flow during operation of the system 200. For example, when the system 200 is disposed in and operating within a vertical well, upstream can be synonymous with downhole, while downstream can be synonymous with uphole.

The system 200 is configured to operate without the use of a protector. Various components of the system 200 perform functions otherwise provided by a typical protector, such that a protector is not required in the system 200. For example, the motor 220 is sealed from the surrounding downhole environment, such that the interior of the motor 220 is not exposed to well fluid. For example, the motor 220 includes a pressure compensator, such as a diaphragm or piston, to equalize pressure between the motor 220 and the wellbore. For example, the motor 220 is coupled to the rotatable shaft 211 by a magnetic coupling, which transmits rotational motion from the motor 220 to the rotatable shaft 211. For example, the motor 220 includes a motor oil expansion chamber that compensates for changes in operating temperature. For example, the thrust balancing apparatus 250 can support thrust loads from the ESP 210. The concepts described here, however, can also be implemented in similar downhole-type systems that include a protector.

FIG. 2B is a schematic diagram of an implementation of the thrust balancing apparatus 250. The thrust balancing apparatus 250 includes a housing 251, a balancing chamber 253, a connecting tube 255, a balancing disk 257, a bushing 259, a washer 261, and upthrust washers 263*a* and 263*b*. Each component of the thrust balancing apparatus 250 can manufactured as a singular, continuous member or as multiple, separate components that are integrated together to form the respective component.

The housing 251 houses the other components of the thrust balancing apparatus 250. For example, the balancing chamber 253, the connecting tube 255, the balancing disk 257, the bushing 259, the washer 261, and the upthrust washers 263*a* and 263*b* are all disposed within the housing 251. In some implementations, the housing 251 is tubular and has an outer diameter that is the same as or similar to an outer diameter of the pump stages 213 of the ESP 210.

Figure 2C:
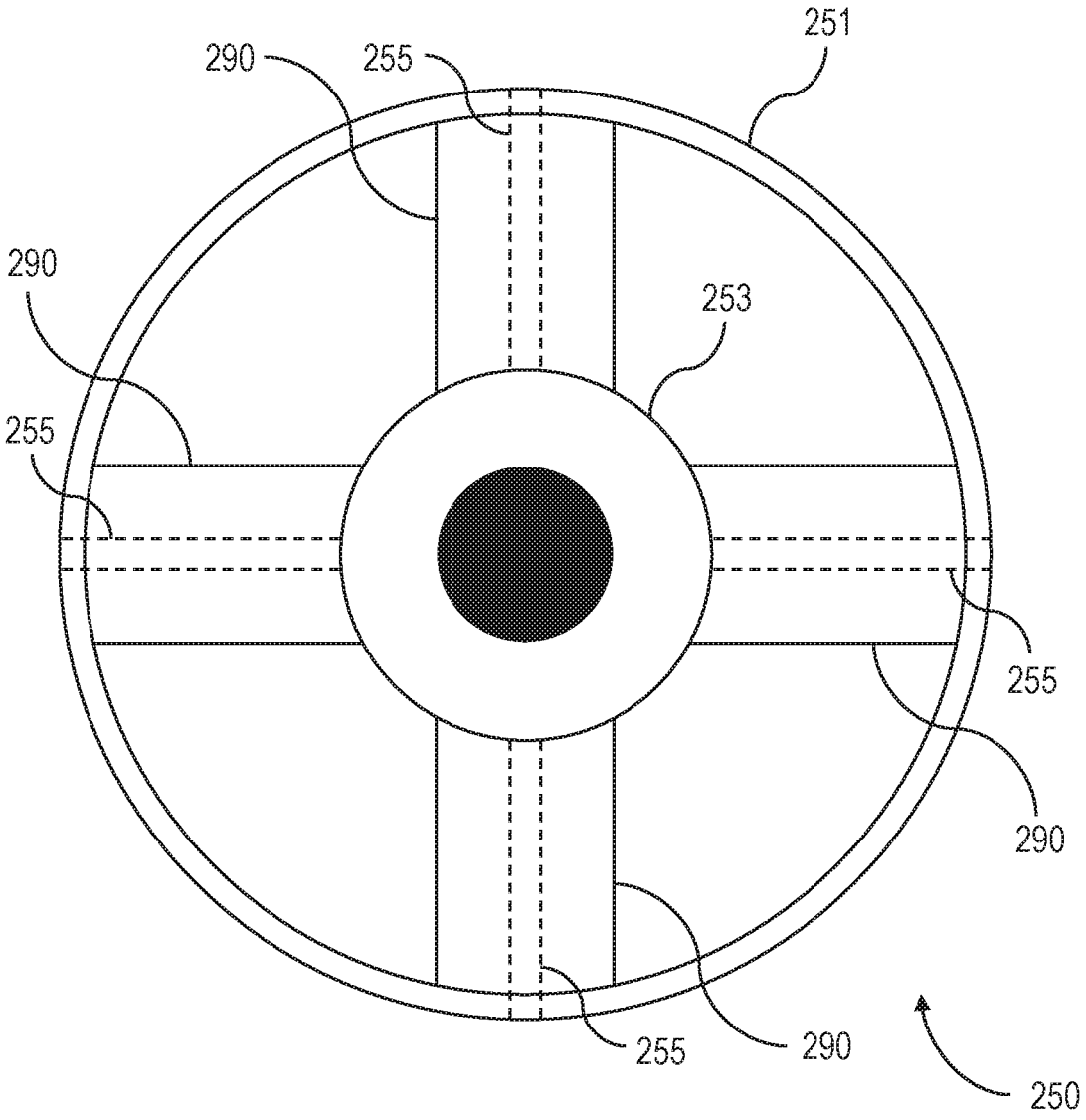
FIG. 2C is a radial cross-section of the apparatus of FIG. 2B.

The balancing chamber 253 is coupled to and disposed within the housing 251. The balancing chamber 253 defines an upper cavity 253*a* and a lower cavity 253*b*. In some implementations, the balancing chamber 253 is fixed in position in relation to the housing 251. The balancing chamber 253 is made of a material that can withstand corrosion and abrasion during operation. In some implementations, the balancing chamber 253 is made of a similar or the same material as the impellers and/or diffusers of the ESP 210. In some implementations, the balancing chamber 253 is made of an austenitic cast iron alloy that includes nickel, such as Ni-Resist (standard or ductile). In some implementations, an outer diameter of the balancing chamber 253 is equal to or less than about 60% of the diameter of the impellers of the ESP 210. In some implementations, an outer diameter of the balancing chamber 253 is equal to or less than about 50% of the outer diameter of the housing 251. In some implementations, a longitudinal length of the balancing chamber 253 is equal to or less than a longitudinal length of a single pump stage 213 of the ESP 210, In some implementations, a web structure 290 fixes the balancing chamber 253 in position within the housing 251. FIG. 2C is a cross-section of the thrust balancing apparatus 250 that shows an implementation of the web structure 290. The web structure 290 can provide structural rigidity to the balancing chamber 253 while also having sufficient flow area to prevent and/or mitigate choking flow through the apparatus 250. The web structure 290 can be sufficiently wide to accommodate the connecting tube 255.

The connecting tube 255 is coupled to the balancing chamber 253 and the housing 251. The connecting tube 255 is configured to establish fluid communication between the balancing chamber 253 and an exterior of the housing 251, such that an interior of the balancing chamber 253 is exposed to fluid surrounding the housing 251 (for example, well fluid). In some implementations, the connecting tube 255 is coupled to the upper cavity 253*a* of the balancing chamber 253 at one end and coupled to a perforation in the housing 251 at another end. The connecting tube 255 is made of a material that can withstand corrosion and abrasion during operation. In some implementations, the connecting tube 255 is made of similar or the same material as the web structure 290 that supports the balancing chamber 253 within the housing 251. In some implementations, the connecting tube 255 is made of an austenitic cast iron alloy that includes nickel, such as Ni-Resist (standard or ductile). In some implementations, the connecting tube 255 is a part of the web structure 290 that supports the balancing chamber 253 within the housing 251. In some implementations, an inner diameter of the connecting tube 255 is in a range of from about 1/16 inch to about 1/4 inch. In some implementations, a longitudinal length of the connecting tube 255 is at least 25% of the inner diameter of the housing 251. Although shown in FIG. 2B as including one connecting tube 255, the thrust balancing apparatus 250 can include additional connecting tubes 255 (as shown in FIG. 2C). In some implementations, multiple connecting tubes 255 make up a part of the web structure 290 that supports the balancing chamber 253 within the housing 251.

Referring back to FIG. 2B, the balancing disk 257 is coupled to and surrounds the rotatable shaft 211 of the ESP 210. The rotatable shaft 211 passes through the balancing chamber 253. In some implementations, the balancing disk 257 is fixed in position in relation to the rotatable shaft 211 and rotates with the rotatable shaft 211. The balancing disk 257 includes a first portion 257*a*, a second portion 257*b*, and a third portion 257*c*. The first portion 257*a* is disposed within the upper cavity 253*a* of the balancing chamber 253. The second portion 257*b* passes through the lower cavity 253*b* of the balancing chamber 253. The third portion 257*c* is external to the balancing chamber 253. In some implementations, the first portion 257*a* includes a first disk, the second portion 257*b* is tubular, and the third portion 257*c* includes a second disk. The outer diameter of the first portion 257*a* is less than an inner diameter of the upper cavity 253*a* of the balancing chamber 253. The balancing chamber 253 defines an opening through which the second portion 257*b* passes. An inner diameter of the opening defined by the balancing chamber 253 is greater than the outer diameter of the second portion 257*b* of the balancing disk 257 but less than the outer diameters of the first portion 257*a* and the third portion 257*c* of the balancing disk 257. The clearance between the opening defined by the balancing chamber 253 and the second portion 257*b* of the balancing disk 257 can be designed to prevent and/or mitigate debris migration across the balancing chamber 253 and balancing disk 257. Similarly, the clearance between the inner diameter of the ring 265 and the second portion 257*b* of the balancing disk 257 can be designed to prevent and/or mitigate debris migration across the balancing chamber 253 and balancing disk 257. Similarly, the clearance between the opening defined by the inner diameter of the upper cavity 253*a* and the outer diameter of the first portion 257*a* can be designed to prevent and/or mitigate debris migration across the balancing chamber 253 and balancing disk 257.

The balancing disk 257 is made of a material that can withstand corrosion and abrasion during operation. In some implementations, the balancing disk 257 is made of similar or the same material as the balancing chamber 253. In some implementations, the balancing disk 257 is made of an austenitic cast iron alloy that includes nickel, such as Ni-Resist (standard or ductile).

The bushing 259 surrounds the rotatable shaft 211 of the ESP 210. The bushing 259 is disposed within the housing 251. In some implementations, a portion of the bushing 259 is tubular and a remaining portion of the bushing 259 is shaped like a disk. The bushing 259 is made of a material that can withstand corrosion and abrasion during operation. In some implementations, the bushing 259 is made of similar or the same material as the balancing chamber 253. In some implementations, the bushing 259 is made of austenitic cast iron alloy that includes nickel, such as Ni-Resist (standard or ductile). In some implementations, the bushing 259 is made of copper. In some implementations, the bushing 259 is made of ceramic material, such as zirconia, tungsten carbine, and silicon carbide. In some implementations, the bushing 259 is coupled to the housing 251. In some implementations, the bushing 259 has an outer diameter that is equal to or approximately equal to the outer diameter of the second disk of the third portion 257*c* of the balancing disk 257.

The washer 261 surrounds the rotatable shaft 211 of the ESP 210. The washer 261 is disposed within the housing 251 between the third portion 257*c* of the balancing disk 257 and the bushing 259. In some implementations, the washer 261 is axially disposed between the bushing 259 and the second disk of the third portion 257*c* of the balancing disk 257. In some implementations, the washer 261 is axially disposed between the disk-shaped portion of the bushing 259 and the second disk of the third portion 257*c* of the balancing disk 257. In such implementations, the washer 261 prevents physical contact between the balancing disk 257 and the bushing 259. The washer 261 can withstand material loss (for example, due to friction) during rotation of the balancing disk 257. In some implementations, the washer 261 is a phenolic washer. In some implementations, an outer diameter of the washer 261 is equal to or approximately equal to the outer diameter of the second disk of the third portion 257*c* of the balancing disk 257. In some implementations, an outer diameter of the washer 261 is equal to or approximately equal to the outer diameter of the bushing 259. In some implementations, the washer 261 has a thickness of at least 1/16 inch.

The upthrust washers 263*a* and 263*b* surround the third portion 257*c* of the balancing disk 257. The upthrust washers 263*a* and 263*b* are disposed within the housing 251 between the third portion 257*c* of the balancing disk 257 and the balancing chamber 253. In some implementations, the upthrust washers 263*a* and 263*b* are axially disposed between balancing chamber 253 and the second disk of the third portion 257*c* of the balancing disk 257. In such implementations, the upthrust washers 263*a* and 263*b* prevent physical contact between the balancing chamber 253 and the second disk of the third portion 257*c* of the balancing disk 257. In some implementations, the upthrust washer 263*a* is fixed to the exterior of the balancing chamber 253, and the upthrust washer 263*b* is fixed to the second disk of the third portion 257*c* of the balancing disk 257. In such implementations, the upthrust washer 263*a* remains stationary, while the upthrust washer 263*b* rotates with the rotatable shaft 211 during operation of the system 200. Similar to the washer 261, the upthrust washers 263*a* and 263*b* can withstand material loss (for example, due to friction) during counter-rotation with respect to each other and during rotation of the balancing disk 257. In some implementations, the upthrust washers 263*a* and 263*b* are phenolic washers. In some implementations, an outer diameter of the upthrust washers 263*a* and 263*b* is equal to or approximately equal to the outer diameter of the second disk of the third portion 257*c* of the balancing disk 257. In some implementations, the upthrust washers 263*a* and 263*b* have a thickness of at least 1/16 inch each.

In some implementations, the upper cavity 253*a* and the lower cavity 253*b* of the balancing chamber 253 are partitioned by a ring 265 that lines an inner circumferential wall of the balancing chamber 253. In such implementations, the second portion 257*b* (tubular portion) of the balancing disk 257 passes through the ring 265. In such implementations, a first spacing 267*a* is defined between the ring 265 and the first disk of the first portion 257*a* of the balancing disk 257, and a second spacing 267*b* is defined between the upthrust washer 263*a* and the upthrust washer 263*b*. The first spacing 267*a* and the second spacing 267*b* can be adjusted to balance a thrust load of the rotatable shaft 211 of the ESP 210.

In some implementations, the thrust balancing apparatus 250 includes a seal 269 that surrounds the rotatable shaft 211 and is radially disposed between the balancing chamber 253 and the rotatable shaft 211 of the ESP 210. In some implementations, the seal 269 is configured to prevent fluid flow between the upper cavity 253*a* of the balancing chamber 253 and an interior of the housing 251 while the rotatable shaft 211 rotates. The selection of the seal 269 can depend on various parameters, such as range of operating temperature, range of operating pressure, type of fluid that the seal 269 is expected to be exposed to, and acceptable leakage level. In some implementations, the seal 269 is a labyrinth-type seal, which is typically associated with insignificant mechanical losses and leakage power losses that do not significantly affect overall pumping efficiency.

Figure 2D:
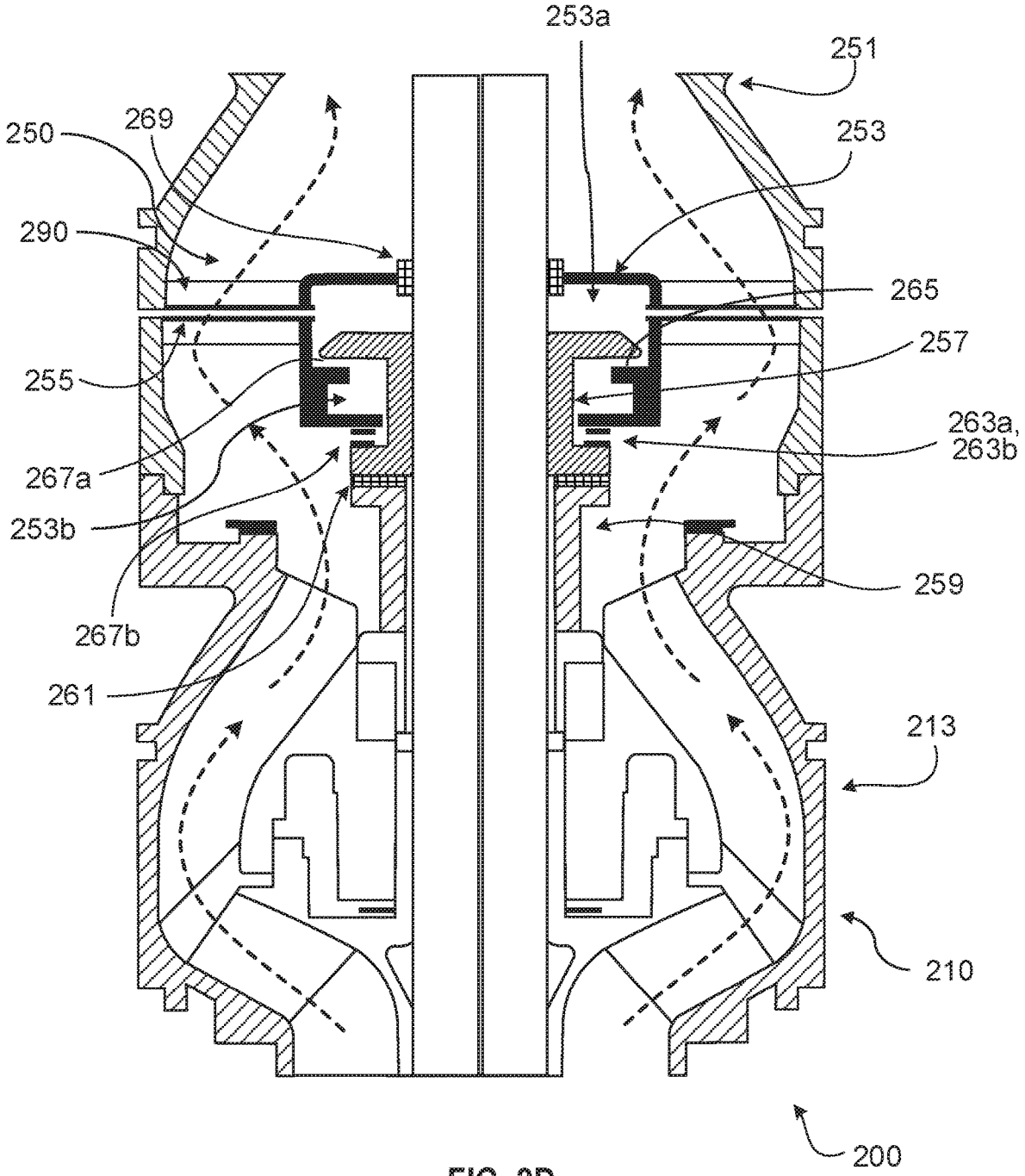
FIG. 2D is a schematic diagram of the apparatus of FIG. 2B coupled to a portion of the system of FIG. 2A.

FIG. 2D is a schematic diagram of the thrust balancing apparatus 250 coupled to a pump stage 213 of the ESP 210. The dotted arrows represent fluid flow through the system 200. In some implementations, as shown in FIG. 2D, the housing 251 of the thrust balancing apparatus 250 can be the same as or similar to the casing of the ESP 210. In some implementations, the washer 261 is omitted. In such implementations, the balancing disk 257 and the bushing 259 can be fixed to the rotatable shaft 211 of the ESP 210. In such implementations, the bushing 259 can be formed as a sleeve surrounding the rotatable shaft 211 of the ESP 210 and fixed in position with respect to the rotatable shaft 211 (for example, by way of a keyway slot formed in the shaft 211). In some implementations, the balancing disk 257 is fixed to the bushing 259. In some implementations, the bushing 259 is fixed to an impeller of the downstream-most pump stage 213 of the ESP 210. In such implementations, the bushing 259 can be formed as a sleeve surrounding the rotatable shaft 211 of the ESP 210 and fixed in position with respect to the impeller and the rotatable shaft 211 (for example, by way of a keyway slot formed in the shaft 211 or a portion of the impeller). In some implementations, the thrust balancing apparatus 250 includes a second pair of upthrust washers, where one upthrust washer is fixed to the first disk of the first portion 257*a* of the balancing disk 257 (rotates with rotatable shaft 211) and the other upthrust washer is fixed to the ring 265 (stationary). In such implementations, the first spacing 267*a* is defined between this second pair of upthrust washers.

Before operation of the ESP 210, the balancing disk 257 rests on top of the washer 261, which rests on top of the disk-shaped portion of the bushing 259. At the beginning of operation of the ESP 210, the pressure within the housing 251 (exterior to the balancing chamber 253) is the greatest pressure in the system thrust balancing apparatus 250. This pressure imposes a downward thrust on the rotatable shaft 211, resulting in a downward axial movement of the rotatable shaft 211 and the balancing disk 257, which is fixed to the rotatable shaft 211. This downward axial movement decreases the first spacing 267*a* (low-pressure orifice) and increases the second spacing 267*b* (high-pressure orifice). This downward axial movement also causes the pressure within the lower cavity 253*b* to increase, as more well fluid flows into the lower cavity 253*b*. The increase in pressure within the lower cavity 253*b* imparts an upward thrust on the balancing disk 257 and, in turn, on the rotatable shaft 211. The cross-sectional area of the first disk of the first portion of the balancing disk 257 can be designed to be sufficiently large to develop the upward thrust to lift the rotatable shaft 211. The upward thrust results in an upward axial movement of the rotatable shaft 211 and the balancing disk 257. The upward axial movement increases the first spacing 267*a* (low-pressure orifice) and decreases the second spacing 267*b* (high-pressure orifice). The decrease in the second spacing 267*b* increases the pressure drop across the second spacing 267*b*. The simultaneous increase in the first spacing 267*a* allows for the pressure within the lower cavity 253*b* to decrease. Both of these effects can reduce the effect of the upward thrust. This "push-and-pull" continues in the thrust balancing apparatus 250 until the balancing disk 257 reaches an equilibrium point that fully supports the thrust load of the ESP 210. The thrust balancing apparatus 250 is capable of reaching equilibrium points across a range of operating conditions of the ESP 210 (for example, different combinations of pumping speeds and flow rates).

Figure 3:
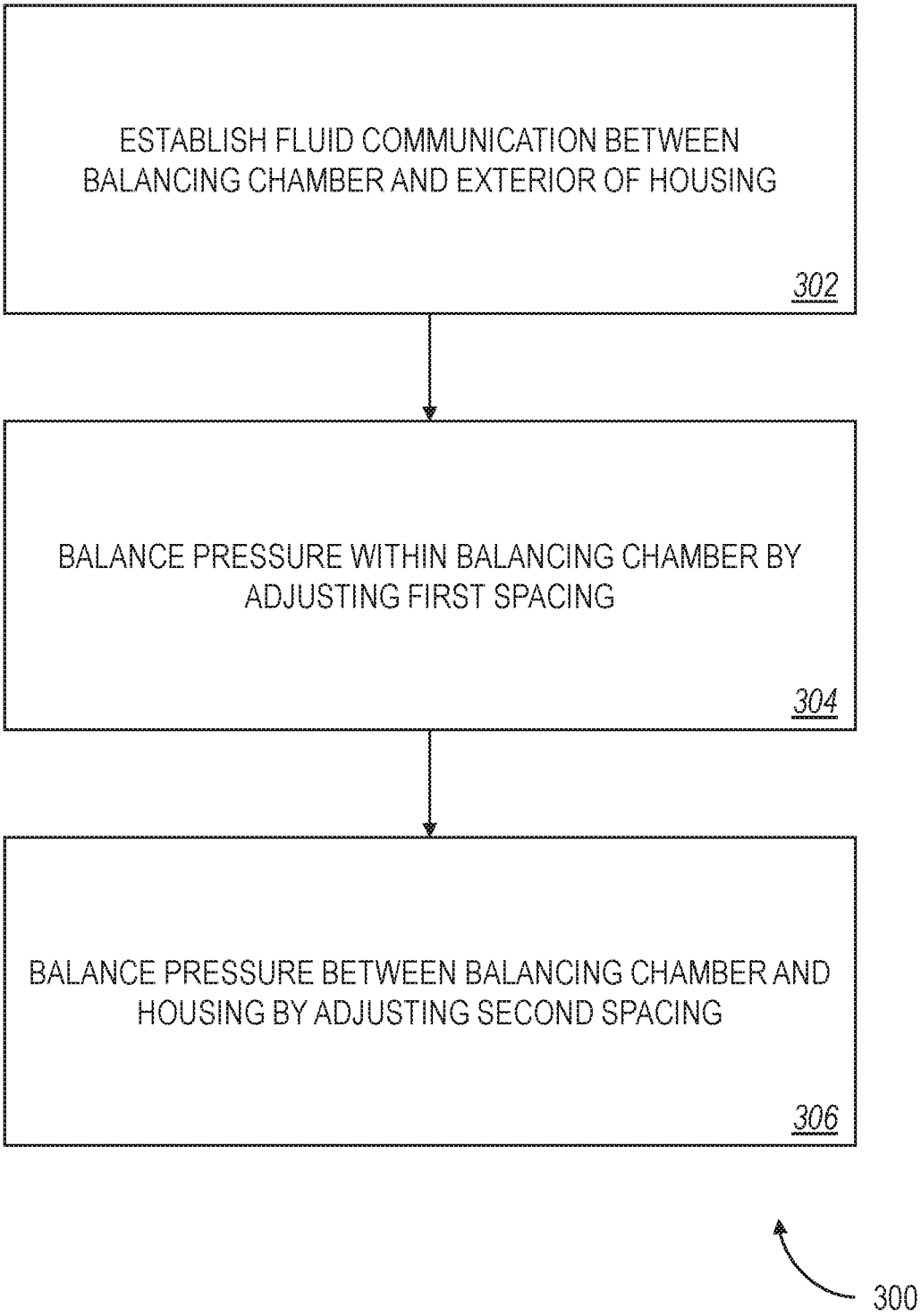
FIG. 3 is a flow chart of an example method that can be implemented by the apparatus of FIG. 2B.

FIG. 3 is a flow chart of an example method 300. The method 300 can be implemented, for example, by the thrust balancing apparatus 250. At step 302, fluid communication between a balancing chamber (for example, the balancing chamber 253) and an exterior of a housing (for example, the housing 251) is established by a connecting tube (for example, the connecting tube 255) that is coupled to the balancing chamber 253 and the housing 251. By establishing fluid communication between the balancing chamber 253 and the exterior of the housing 251 at step 302, an interior of the balancing chamber 253 is exposed to fluid surrounding the housing 251. As described previously, the balancing chamber 253 is coupled to and disposed within the housing 251, and the balancing chamber 253 defines an upper cavity 253*a* and a lower cavity 253*b*. In some implementations, establishing fluid communication between the balancing chamber 253 and the exterior of the housing 251 at step 302 includes establishing fluid communication between the upper cavity 253*a* of the balancing chamber 253 and the exterior of the housing 251.

At step 304, pressure within the balancing chamber 253 is balanced by adjusting a first spacing (for example, the first spacing 267*a*). The first spacing 267*a* can be increased or decreased at step 304. As described previously, the balancing disk 257 is coupled to and surrounds the rotatable shaft 211 (of the ESP 210), which passes through the balancing chamber 253. The ring 265 partitions the balancing chamber 253 into the upper cavity 253*a* and the lower cavity 253*b*. The first spacing 267*a* is defined between the balancing disk 257 and the ring 265.

At step 306, pressure between the balancing chamber 253 and the housing 251 is balanced by adjusting a second spacing (for example, the second spacing 267*b*). The second spacing 267*b* can be increased or decreased at step 306. As described previously, the upthrust washers 263*a* and 263*b* surround the balancing disk 257 and are disposed within the housing 251 between the balancing disk 257 and the balancing chamber 253. The second spacing 267*b* is defined between the upthrust washers 263*a* and 263*b*. Balancing pressure within the balancing chamber 253 and balancing pressure between the balancing chamber 253 and the housing 251 results in balancing a thrust load of the rotatable shaft 211 while the rotatable shaft 211 rotates. In some implementations, adjusting the second spacing 267*b* includes adjusting an axial spacing between the upthrust washers 263*a* and 263*b*.

In some implementations, fluid flow between the upper cavity 253*a* of the balancing chamber 253 and an interior of the housing 251 is prevented by a seal (for example, the seal 269). As described previously, the seal 269 can surround the rotatable shaft 211 and be radially disposed between the rotatable shaft 211 and the balancing chamber 253. Although shown in FIG. 3 as a progression from step 302 to step 304 to step 306, the various steps of method 300 can occur concurrently in parallel and do not necessarily need to be performed sequentially. For example, adjusting the first spacing 267*a* to balance pressure within the balancing chamber 253 at step 304 and adjusting the second spacing 267*b* to balance pressure between the balancing chamber 253 and the housing 251 at step 306 can occur simultaneously. Further, the various steps of method 300 can occur repeatedly and continuously, for example, throughout the operation of the ESP 210.

While this specification contains many specific implementation details, these should not be construed as limitations on the scope of what may be claimed, but rather as descriptions of features that may be specific to particular implementations. Certain features that are described in this specification in the context of separate implementations can also be implemented, in combination, in a single implementation. Conversely, various features that are described in the context of a single implementation can also be implemented in multiple implementations, separately, or in any sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

As used in this disclosure, the terms "a," "an," or "the" are used to include one or more than one unless the context clearly dictates otherwise. The term "or" is used to refer to a nonexclusive "or" unless otherwise indicated. The statement "at least one of A and B" has the same meaning as "A, B, or A and B." In addition, it is to be understood that the phraseology or terminology employed in this disclosure, and not otherwise defined, is for the purpose of description only and not of limitation. Any use of section headings is intended to aid reading of the document and is not to be interpreted as limiting; information that is relevant to a section heading may occur within or outside of that particular section.

As used in this disclosure, the term "about" or "approximately" can allow for a degree of variability in a value or range, for example, within 10%, within 5%, or within 1% of a stated value or of a stated limit of a range.

As used in this disclosure, the term "substantially" refers to a majority of, or mostly, as in at least about 50%, 60%, 70%, 80%, 90%, 95%, 96%, 97%, 98%, 99%, 99.5%, 99.9%, 99.99%, or at least about 99.999% or more.

Values expressed in a range format should be interpreted in a flexible manner to include not only the numerical values explicitly recited as the limits of the range, but also to include all the individual numerical values or sub-ranges encompassed within that range as if each numerical value and sub-range is explicitly recited. For example, a range of "0.1% to about 5%" or "0.1% to 5%" should be interpreted to include about 0.1% to about 5%, as well as the individual values (for example, 1%, 2%, 3%, and 4%) and the sub-ranges (for example, 0.1% to 0.5%, 1.1% to 2.2%, 3.3% to 4.4%) within the indicated range. The statement "X to Y" has the same meaning as "about X to about Y," unless indicated otherwise. Likewise, the statement "X, Y, or Z" has the same meaning as "about X, about Y, or about Z," unless indicated otherwise.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results. In certain circumstances, multitasking or parallel processing (or a combination of multitasking and parallel processing) may be advantageous and performed as deemed appropriate.

Moreover, the separation or integration of various system modules and components in the previously described implementations should not be understood as requiring such separation or integration in all implementations, and it should be understood that the described components and systems can generally be integrated together or packaged into multiple products.

Accordingly, the previously described example implementations do not define or constrain the present disclosure. Other changes, substitutions, and alterations are also possible without departing from the spirit and scope of the present disclosure.

What is claimed is:

1. A thrust balancing apparatus for a pump, the apparatus comprising:

a housing;

a balancing chamber coupled to and disposed within the housing, the balancing chamber defining an upper cavity and a lower cavity;

a connecting tube coupled to the balancing chamber and the housing, the connecting tube configured to establish fluid communication between the balancing chamber and an exterior of the housing, such that an interior of the balancing chamber is exposed to fluid surrounding the housing;

a balancing disk coupled to and surrounding a rotatable shaft of the pump passing through the balancing chamber, wherein a first portion of the balancing disk is disposed within the upper cavity of the balancing chamber, a second portion of the balancing disk passing through the lower cavity of the balancing chamber, and a third portion of the balancing disk is external to the balancing chamber;

a bushing disposed within the housing and surrounding the rotatable shaft;

a washer surrounding the rotatable shaft and disposed within the housing between the third portion of the balancing disk and the bushing; and a pair of upthrust washers surrounding the third portion of the balancing disk and disposed within the housing between the third portion of the balancing disk and the balancing chamber.

2. The apparatus of claim 1, wherein the housing is configured to be positioned downstream of a pump stage of the pump.

3. The apparatus of claim 1, wherein:

the first portion of the balancing disk comprises a first disk;

the second portion of the balancing disk is tubular; and the third portion of the balancing disk comprises a second disk.

4. The apparatus of claim 3, wherein the washer is axially disposed between the bushing and the second disk of the third portion of the balancing disk, and the pair of upthrust washers is axially disposed between the balancing chamber and the second disk of the third portion of the balancing disk.

5. The apparatus of claim 4, wherein the connecting tube is coupled to the upper cavity of the balancing chamber.

6. The apparatus of claim 5, wherein the upper cavity and the lower cavity of the balancing chamber are partitioned by a ring lining an inner circumferential wall of the balancing chamber, the second portion of the balancing disk passing through the ring.

7. The apparatus of claim 6, wherein a first spacing is defined between the ring and the first disk of the first portion of the balancing disk, a second spacing is defined between the pair of upthrust washers, and the first spacing and the second spacing are adjustable to balance a thrust load of the rotatable shaft.

8. The apparatus of claim 7, comprising a seal surrounding the rotatable shaft and radially disposed between the rotatable shaft and the balancing chamber, the seal configured to prevent fluid flow between the upper cavity of the balancing chamber and an interior of the housing.

9. A system comprising:

an electric submersible pump (ESP) independent of a protector, the ESP comprising a plurality of pump stages and a rotatable shaft; and a thrust balancing apparatus located downstream of the plurality of pump stages of the ESP, the thrust balancing apparatus comprising:

a housing;

a balancing chamber coupled to and disposed within the housing, the balancing chamber defining an upper cavity and a lower cavity;

a connecting tube coupled to the balancing chamber and the housing, the connecting tube configured to establish fluid communication between the balancing chamber and an exterior of the housing, such that an interior of the balancing chamber is exposed to fluid surrounding the housing;

a balancing disk coupled to and surrounding the rotatable shaft passing through the balancing chamber, wherein a first portion of the balancing disk is disposed within the upper cavity of the balancing chamber, a second portion of the balancing disk passing through the lower cavity of the balancing chamber, and a third portion of the balancing disk is external to the balancing chamber;

a bushing disposed within the housing and surrounding the rotatable shaft;

a washer surrounding the rotatable shaft and disposed within the housing between the third portion of the balancing disk and the bushing; and a pair of upthrust washers surrounding the third portion of the balancing disk and disposed within the housing between the third portion of the balancing disk and the balancing chamber.

10. The system of claim 9, wherein:

the first portion of the balancing disk comprises a first disk;

the second portion of the balancing disk is tubular; and the third portion of the balancing disk comprises a second disk.

11. The system of claim 10, wherein the washer is axially disposed between the bushing and the second disk of the third portion of the balancing disk, and the pair of upthrust washers is axially disposed between the balancing chamber and the second disk of the third portion of the balancing disk.

12. The system of claim 11, wherein the connecting tube is coupled to the upper cavity of the balancing chamber.

13. The system of claim 12, wherein the upper cavity and the lower cavity of the balancing chamber are partitioned by a ring lining an inner circumferential wall of the balancing chamber, the second portion of the balancing disk passing through the ring.

14. The system of claim 13, wherein a first spacing is defined between the ring and the first disk of the first portion of the balancing disk, a second spacing is defined between the pair of upthrust washers, and the first spacing and the second spacing are adjustable to balance a thrust load of the rotatable shaft.

15. The system of claim 14, wherein the thrust balancing apparatus comprises a seal surrounding the rotatable shaft and radially disposed between the rotatable shaft and the balancing chamber, the seal configured to prevent fluid flow between the upper cavity of the balancing chamber and an interior of the housing.

16. A method comprising:

establishing, by a connecting tube coupled to a balancing chamber and a housing, fluid communication between the balancing chamber and an exterior of the housing, thereby exposing an interior of the balancing chamber to fluid surrounding the housing, the balancing chamber coupled to and disposed within the housing, the balancing chamber defining an upper cavity and a lower cavity;

balancing pressure within the balancing chamber by adjusting a first spacing, wherein a balancing disk is coupled to and surrounding a rotatable shaft passing through the balancing chamber, a ring lining an inner circumferential wall of the balancing chamber partitions the balancing chamber into the upper cavity and the lower cavity, and the first spacing is defined between the balancing disk and the ring; and balancing pressure between the balancing chamber and the housing by adjusting a second spacing, wherein a pair of upthrust washers surrounding the balancing disk is disposed within the housing between the balancing disk and the balancing chamber, the second spacing is defined between the pair of upthrust washers, and balancing the pressure within the balancing chamber and balancing the pressure between the balancing chamber and the housing results in balancing a thrust load of the rotatable shaft while the rotatable shaft rotates.

17. The method of claim 16, wherein:

the balancing disk comprises:

a first portion comprising a first disk disposed within the upper cavity of the balancing chamber;

a second portion that is tubular and passes through the lower cavity of the balancing chamber; and a third portion comprising a second disk that is external to the balancing chamber;

the pair of upthrust washers is disposed axially in between the balancing chamber and the second disk of the third portion of the balancing disk; and adjusting the second spacing comprises adjusting an axial spacing between the pair of upthrust washers.

18. The method of claim 17, wherein the connecting tube is coupled to the upper cavity of the balancing chamber, and establishing fluid communication between the balancing chamber and the exterior of the housing comprises establishing fluid communication between the upper cavity of the balancing chamber and the exterior of the housing.

19. The method of claim 18, comprising preventing, by a seal surrounding the rotatable shaft and radially disposed between the rotatable shaft and the balancing chamber, fluid flow between the upper cavity of the balancing chamber and an interior of the housing.

* * * * *